US009123209B2

(12) United States Patent
Pacey et al.

(10) Patent No.: US 9,123,209 B2
(45) Date of Patent: Sep. 1, 2015

(54) SYMBOL COLLECTION DURING REEL SPIN

(71) Applicant: WMS Gaming Inc., Waukegan, IL (US)

(72) Inventors: Larry J. Pacey, Chicago, IL (US); Joel R. Jaffe, Glenview, IL (US); Dion K. Aoki, Chicago, IL (US); Jamie W. Vann, Chicago, IL (US); Benjamin T. Gomez, Chicago, IL (US); Jeremy M. Hornik, Chicago, IL (US); Daniel P. Louie, Chicago, IL (US); Jeremie D. Moll, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 189 days.

(21) Appl. No.: 13/714,684

(22) Filed: Dec. 14, 2012

(65) Prior Publication Data

US 2013/0157741 A1 Jun. 20, 2013

Related U.S. Application Data

(60) Provisional application No. 61/576,125, filed on Dec. 15, 2011.

(51) Int. Cl.
*G07F 17/32* (2006.01)
*G07F 17/34* (2006.01)

(52) U.S. Cl.
CPC ..... *G07F 17/34* (2013.01); *G07F 17/3265* (2013.01)

(58) Field of Classification Search
USPC ..... 463/20, 22
See application file for complete search history.

(56) References Cited

U.S. PATENT DOCUMENTS

| | | | | |
|---|---|---|---|---|
| 4,570,934 | A | 2/1986 | Smyth | |
| 6,203,430 | B1 | 3/2001 | Walker et al. | |
| 6,517,433 | B2 | 2/2003 | Loose et al. | |
| 7,070,502 | B1 | 7/2006 | Bussick et al. | |
| 7,144,322 | B2 | 12/2006 | Gomez et al. | |
| 7,850,519 | B2 | 12/2010 | Majima et al. | |
| 2002/0155881 | A1 | 10/2002 | Yoshida | |
| 2003/0045345 | A1 | 3/2003 | Berman | |
| 2010/0062196 | A1 | 3/2010 | Bezek et al. | |
| 2010/0234099 | A1 | 9/2010 | Rasmussen et al. | |
| 2014/0179398 | A1* | 6/2014 | Vandaele | 463/20 |
| 2014/0274282 | A1* | 9/2014 | Mastropietro et al. | 463/20 |
| 2014/0274290 | A1* | 9/2014 | Loose | 463/20 |
| 2015/0011291 | A1* | 1/2015 | Nauman | 463/20 |

* cited by examiner

*Primary Examiner* — Pierre E Elisca
(74) *Attorney, Agent, or Firm* — Nixon Peabody LLP

(57) ABSTRACT

A method for conducting a wagering game via a gaming terminal includes receiving, via an input device, a wager to play the wagering game. An array of symbol positions arranged in a plurality of columns is displayed, on one or more display devices. At least a portion of a plurality of symbols is visually moved with respect to the array of symbol positions on the one or more display devices. One or more of the plurality of the symbols are special symbols. In response to one or more of the special symbols being visually moved on the one or more display devices, the visually moved special symbols are caused to be visually collected in a symbol collection area adjacent to the array of symbol positions on the one or more display devices.

29 Claims, 36 Drawing Sheets

SYMBOL COLLECTION DURING REEL SPIN

CROSS-REFERENCE TO RELATED APPLICATION

This application claims the benefit of U.S. Provisional Application No. 61/576,125, filed Dec. 15, 2011, which is hereby incorporated by reference herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus, systems, and methods and, more particularly, to utilizing moving symbols during reel spins to trigger various bonus features.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player

SUMMARY OF THE INVENTION

According to one aspect of the present disclosure, a method for conducting a wagering game via a gaming terminal includes receiving, via an input device, a wager to play the wagering game. An array of symbol positions arranged in a plurality of columns is displayed, on one or more display devices. At least a portion of a plurality of symbols is visually moved with respect to the array of symbol positions on the one or more display devices. One or more of the plurality of the symbols are special symbols. In response to one or more of the special symbols being visually moved on the one or more display devices, the visually moved special symbols are caused to be visually collected in a symbol collection area adjacent to the array of symbol positions on the one or more display devices.

According to another aspect of the disclosure, a method for conducting a wagering game via a gaming terminal includes receiving, via an input device, a wager to play the wagering game. A plurality of symbol-bearing reels is displayed, on one or more display devices. Each of the symbol-bearing reels includes a plurality of symbols. At least one of the symbols is a bonus symbol. The symbol-bearing reels are caused to visually rotate such that at least a portion of the symbols are displayed on the one or more display devices during the visual rotation. In response to the bonus symbol being displayed on the one or more display devices during the visual rotation of at least one of the symbol-bearing reels, the bonus symbol is caused to visually move from the rotating symbol-bearing reel towards at least one object. The moving bonus symbol is interacted with the at least one object.

According to another aspect of the disclosure, a method for conducting a wagering game via a gaming terminal includes receiving, via an input device, a wager to play the wagering game. A base array of symbol positions arranged in a plurality of columns is displayed, on one or more display devices. A plurality of symbols is caused to be visually moved with respect to the base array of symbol positions on the one or more display devices. One of the symbols is an array-expansion symbol. In response to the array-expansion symbol being visually moved with respect to the base array of symbol positions, the base array of symbol positions is expanded into an expanded array of symbol positions. The expanded array of symbol positions includes the base array of symbol positions and at least one additional symbol position. The expanded array of symbol positions is displayed, on the one or more display devices. At least a portion of the plurality of symbols is caused to be continually visually moved with respect to the expanded array of symbol positions on the one or more display devices.

According to another aspect of the disclosure, a method for conducting a community wagering game including a plurality of gaming terminals includes receiving, via at least one input device, a wager to play the wagering game on at least one of the gaming terminals. A plurality of symbol-bearing reels is displayed, on one or more display devices. The symbol-bearing reels include a plurality of symbols and at least one of the symbols is a trigger symbol. A community-bonus symbol for each of the plurality of gaming terminals is displayed on one or more community display devices. The symbol-bearing reels are caused to visually rotate such that at least a portion of the symbols are displayed on the one or more display devices during the visual rotation. In response to the trigger symbol being displayed on the one or more display devices during the visual rotation of at least one of the symbol-bearing reels, the community-bonus symbol is visually incremented on the one or more community display devices corresponding to the gaming terminal displaying the trigger symbol during the visual rotation of the symbol-bearing reels.

According to yet another aspect of the disclosure, computer readable storage media is encoded with instructions for directing a gaming system to perform the above methods.

Additional aspects of the disclosure will be apparent to those of ordinary skill in the art in view of the detailed description of various embodiments, which is made with reference to the drawings, a brief description of which is provided below.

Figure 1:
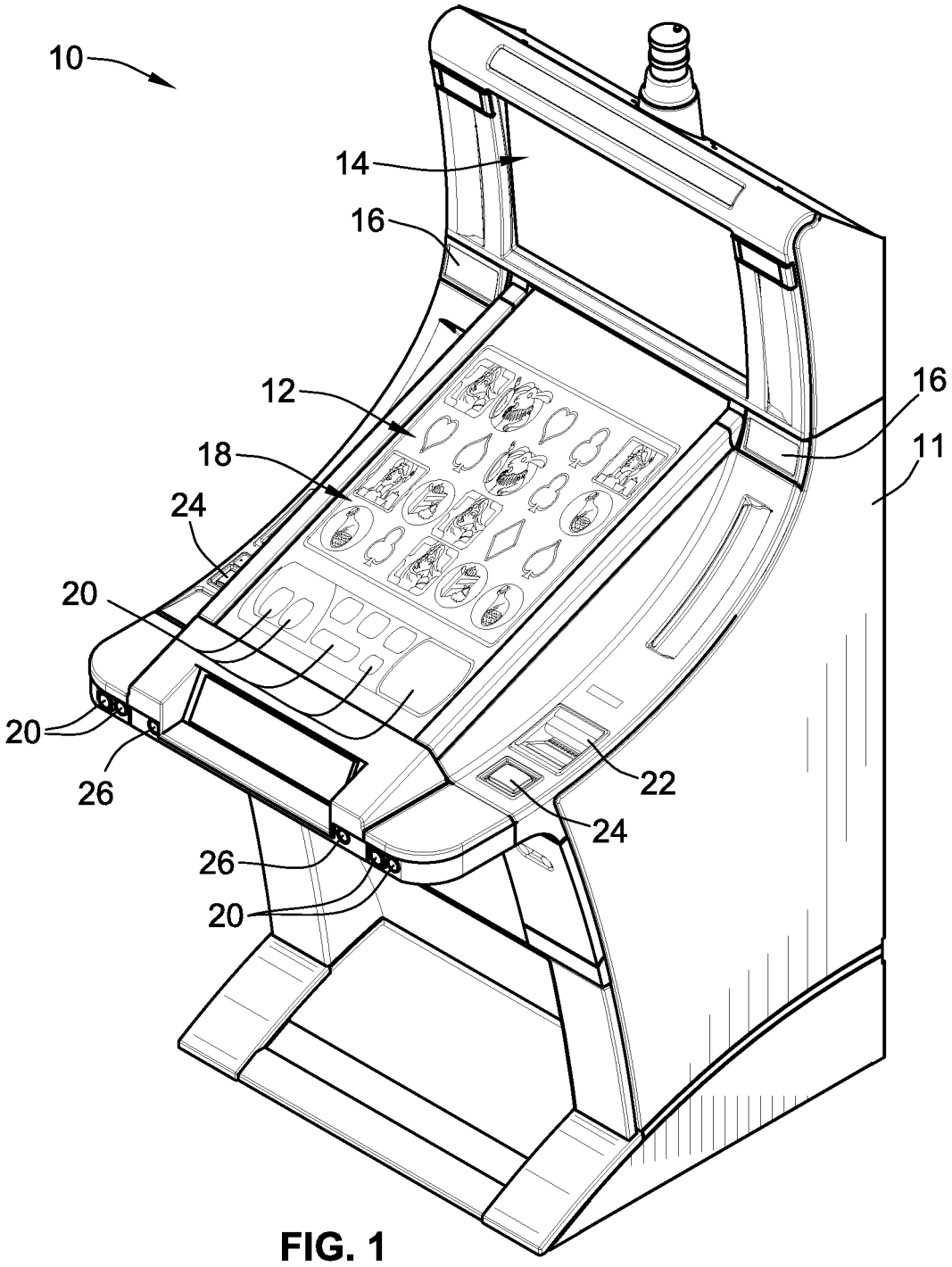
FIG. 1 is a perspective view of a free-standing gaming terminal according to some aspects of the present disclosure.

While the disclosure is susceptible to various modifications and alternative forms, specific embodiments have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of the disclosure as defined by the appended claims.

DETAILED DESCRIPTION

While this disclosure is susceptible of embodiment in many different forms, there is shown in the drawings and will herein be described in detail preferred embodiments of the disclosure with the understanding that the present disclosure is to be considered as an exemplification of the principles of the disclosure and is not intended to limit the broad aspect of the disclosure to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

Referring to FIG. 1, there is shown a gaming terminal 10 similar to those used in gaming establishments, such as casinos. With regard to the present disclosure, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433 and Patent Application Publication Nos. US2010/0062196 and US2010/0234099, which are incorporated herein by reference in their entireties.

The gaming terminal 10 illustrated in FIG. 1 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 2:
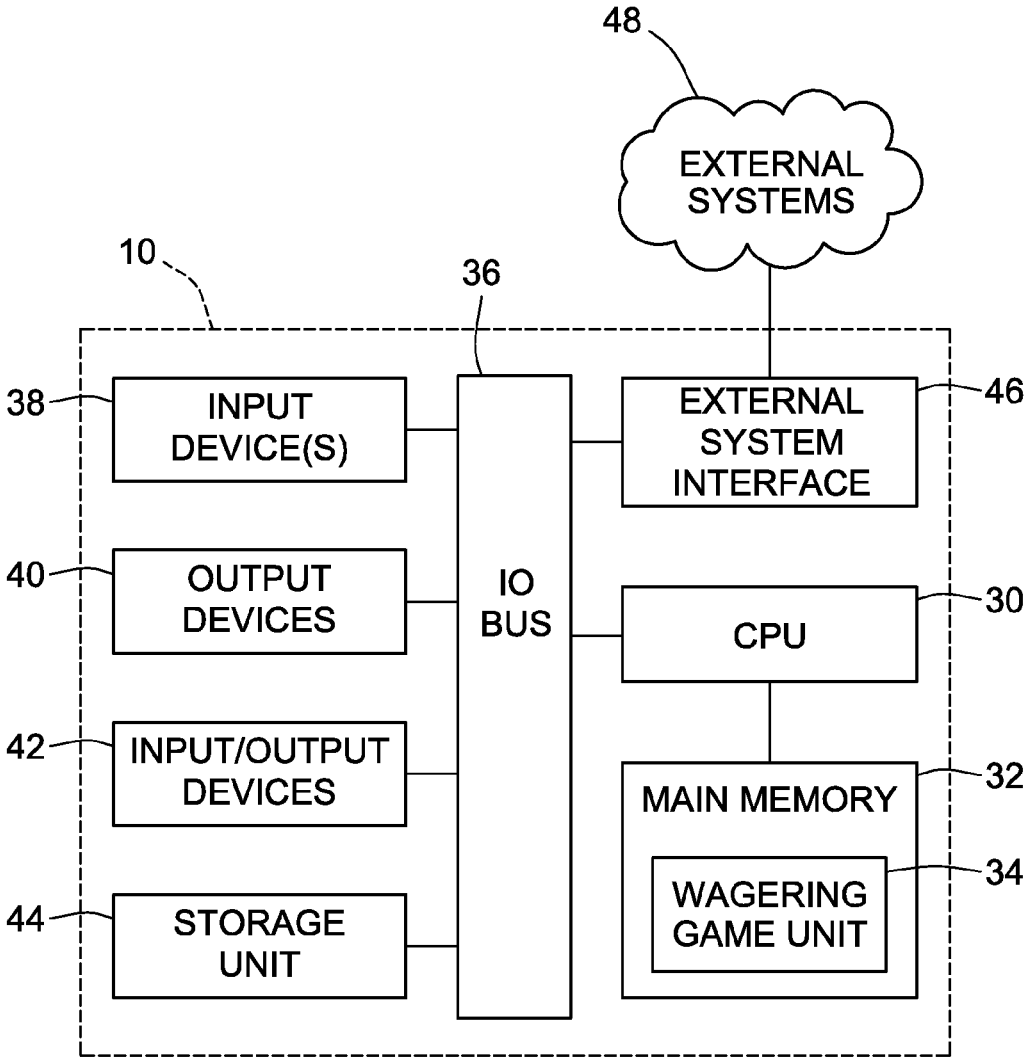
FIG. 2 (PRIOR ART)
FIG. 2 is a schematic view of a gaming system according to some aspects of the present disclosure.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
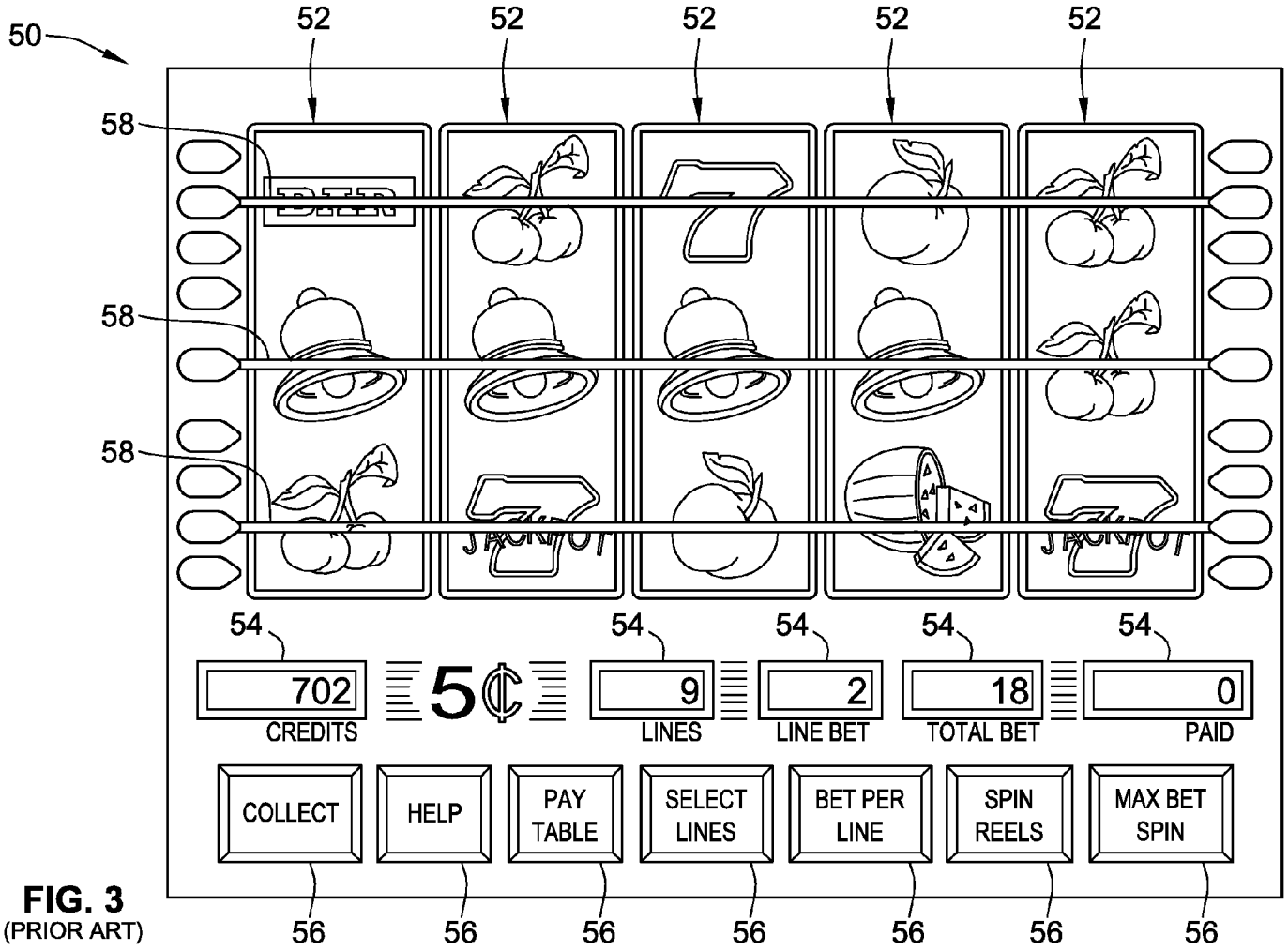
FIG. 3 (PRIOR ART)
FIG. 3 is an image of an exemplary basic-game screen of a wagering game displayed on a gaming terminal according to some aspects of the present disclosure.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Collectable Symbol Selection

Figure 4:
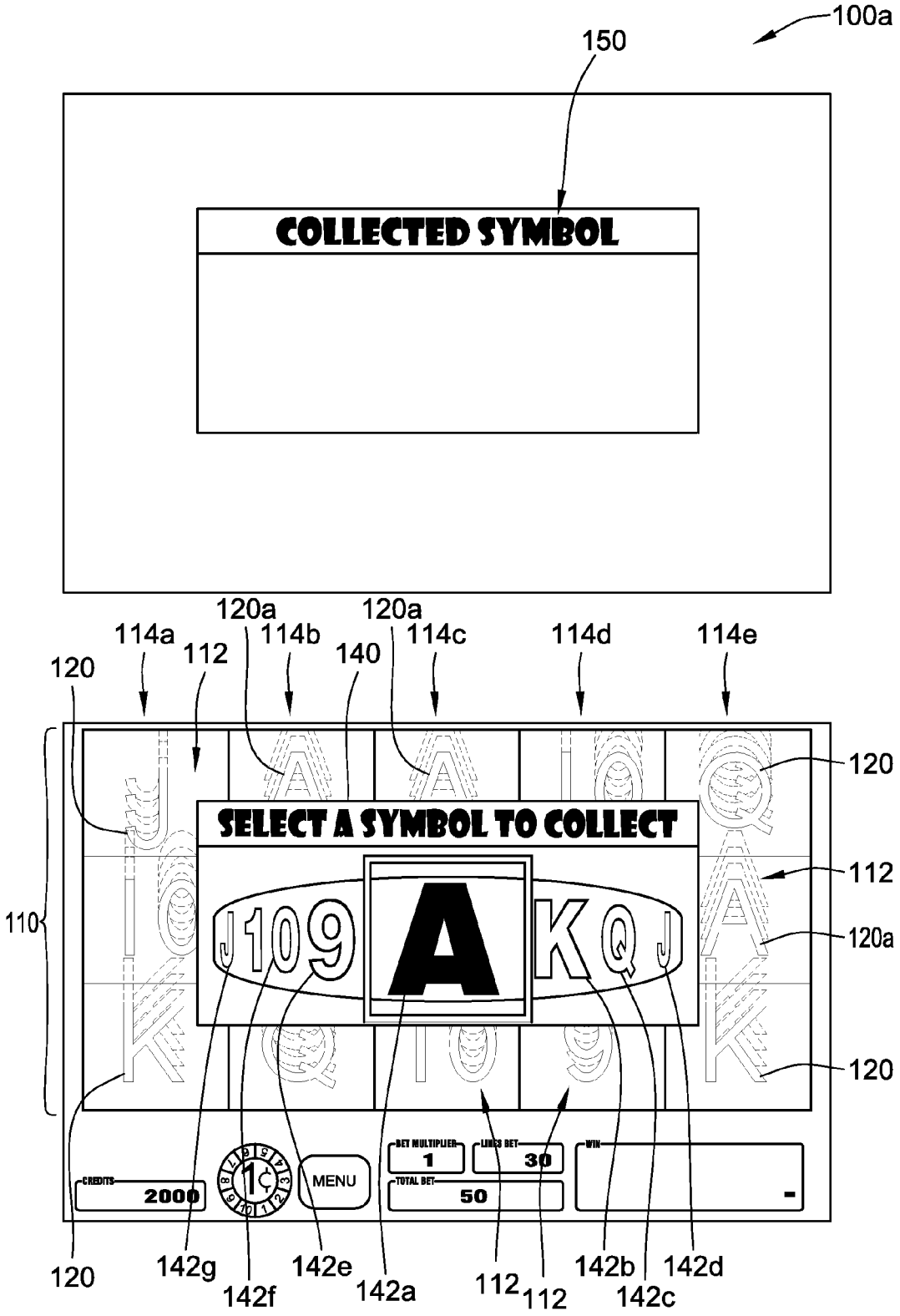
FIG. 4 is an image of an exemplary screen of a wagering game including a popup symbol selection window displayed on a gaming terminal according to some aspects of the present disclosure.

The primary display area 12 and/or the secondary display area 14 can be used for displaying one or more portions of a wagering game. Referring to FIG. 4, a screen shot 100*a* of the primary display area 12 and/or the secondary display area 14 illustrates an array of symbol positions 110, a popup symbol selection window 140, and a symbol collection area 150 used in conducting a wagering game.

The array of symbol positions 110 is a 3×5 matrix of symbol positions 112 arranged in five columns 114*a-e* (i.e., fifteen symbol positions 112). The array of symbol positions 110 is formed by a plurality of symbol-bearing reels such that each of the columns 114*a-e* is occupied by a single one of the reels and each of the reels bears at least a portion of a plurality of symbols 120. The symbol bearing reels can be mechanical reels, displayed simulated reels, or a combination thereof.

While the gaming terminal 10 conducts a play of the wagering game, each of the columns 114*a-e*, or each of the symbol-bearing reels, spins or illustrates a simulated spin to appear as if each of the columns 114*a-e* is spinning prior to displaying an outcome. The displayed symbols 120 are shown in FIG. 4 (and throughout the figures) at least in partial phantom to illustrate that the symbols 120 are moving and not fixed within the array of symbol positions 110, such as, for example, when a randomly selected outcome of the wagering game is displayed (see e.g., FIG. 6C illustrating a random outcome of the wagering game). During the spinning or simulated spinning, at least a portion of the plurality of symbols 120 is visually moved with respect to the array of symbol positions 110. As shown, the symbol-bearing reels spin and/or move such that symbols on the reels appear to enter the array of symbol positions 110 from a top edge of the array of symbol positions 110 and visually move downward until the symbols disappear off a bottom edge of the array of symbol positions 110. In some cases, depending on the number of symbols associated with each symbol-bearing reel, the symbols 120 can be spun through the array of symbol positions 110 multiple times prior to stopping such that an outcome of the wagering game is displayed.

At the beginning of a play of the wagering game, all of the columns 114*a-e* spin and then stop spinning in a predetermined order (e.g., the first column 114*a* stops spinning first and displays its outcome, then the second column 114*b* stops and displays its outcome, etc.). As each column 114*a-e* stops spinning, a portion of a randomly selected outcome of symbols is displayed on the primary display area 12. Prior to the columns 114*a-e* stopping to spin during a play of the wagering game and/or after an outcome of a previous play of the wagering game is displayed, the popup symbol collection window 140 is displayed, such as, for example, shown in FIG. 4.

The popup symbol collection window 140 includes a plurality of player selectable elements 142*a-g* that can be selected by a player of the wagering game via one or more input devices (e.g., touch screen, input button, etc.). Each of the player selectable elements 142*a-g* is associated with one of the plurality of symbols 120 such that the popup symbol collection window 140 allows the player to decide which one of the symbols 120 the player wants to collect in the symbol collection area 150 during play of the wagering game. Alternatively, the player can be allowed to select two or more of the symbols 120 to collect. As shown, for the illustrated example in FIGS. 4-5C, the selected symbol 120*a* is the "A" symbol which corresponds to the player selectable element 142*a*. The selected and/or collected symbols are also referred to herein as a special symbols, which can be high paying symbols, wild symbols, scatter pay symbols, bonus triggering symbols, any other known type of symbols, or any combination thereof. The player can select a different symbol after each play of the wagering game, or alternatively, the selected symbol 120*a* can automatically remain selected for a predetermined number of plays of the wagering game after an initial selection (e.g., 2 games, 5 games, 10 games, until a player's credits run out, until a player cashes out, etc.).

Collection of Symbols

Figure 5A:
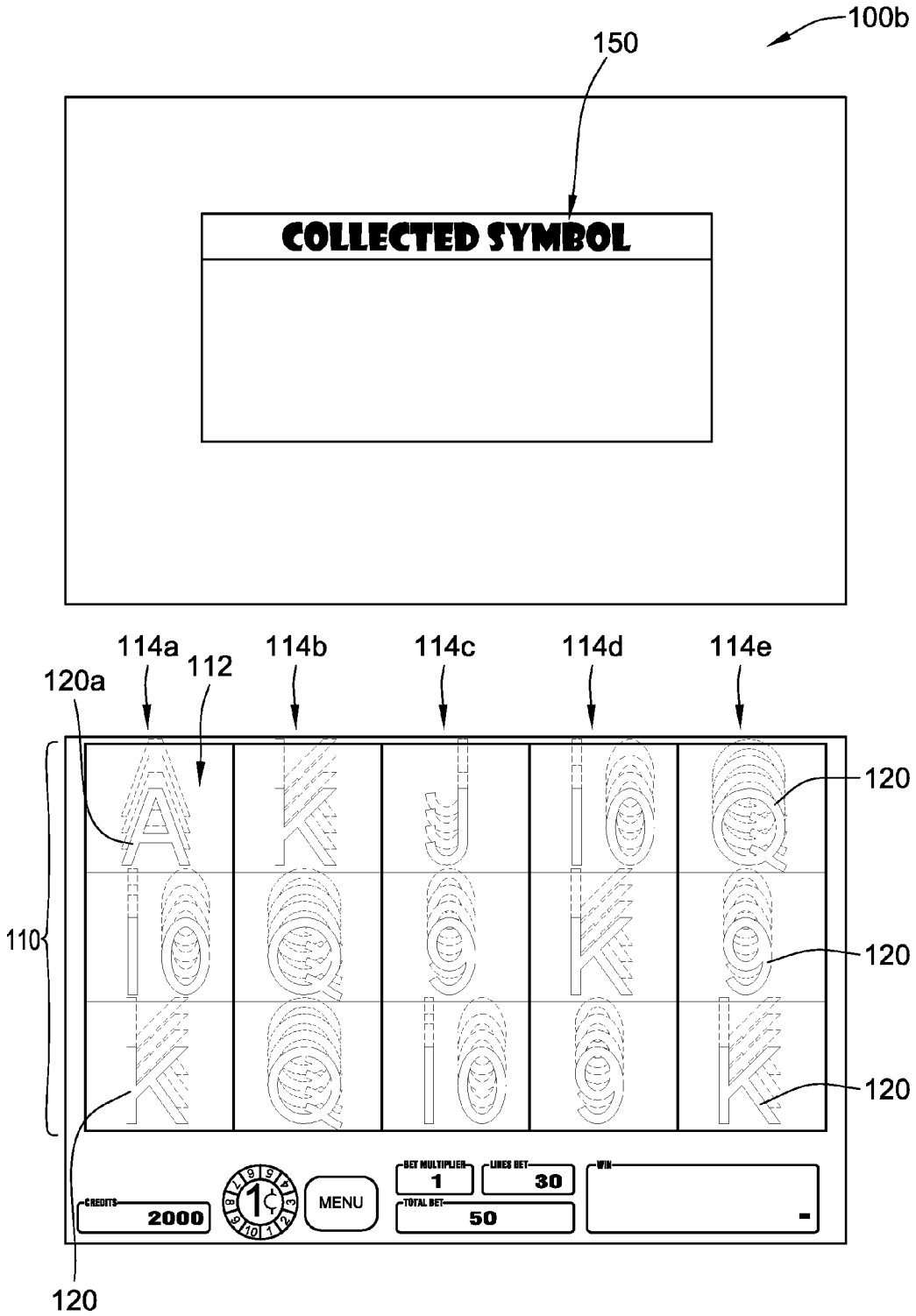
FIGS. 5A-5C are images of exemplary screens of a wagering game including a symbol collection area displayed on a gaming terminal according to some aspects of the present disclosure.
Figure 5B:
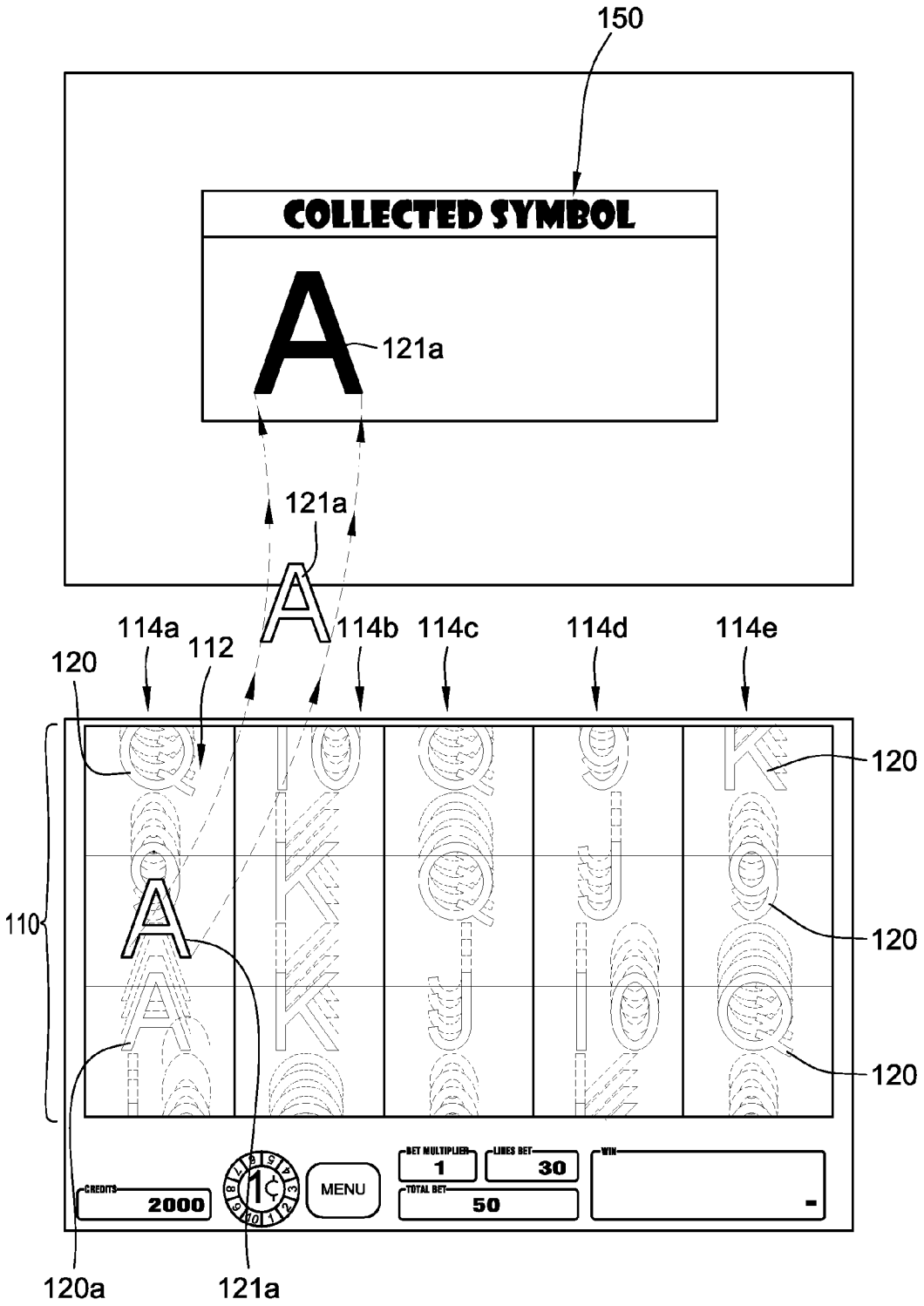

After the player makes a selection of one of the player selectable elements 142*a-g*, the window 140 disappears and the play of the wagering game continues with the reels spinning as shown in a screenshot 100*b* of FIG. 5A. Referring to FIGS. 5A and 5B, in response to the selected symbol 120*a* appearing in the array of symbol positions 110 during the spinning of the symbol-bearing reels (i.e., the selected symbol is visually moved with respect to the array of symbol positions 110), the selected symbol 120*a* is visually collected in the symbol collection area 150. The selected symbol 120*a* visually moves or floats off of the reel and is displayed in the symbol collection area 150 as a collected symbol 121*a*, as illustrated in FIG. 5B. Each time one of the selected symbols 120*a* spins through the array of symbol positions 110 on one of the symbol-bearing reels, the selected symbol 120*a* is collected in the symbol collection area 150 as a collected symbol 121.

Figure 5C:
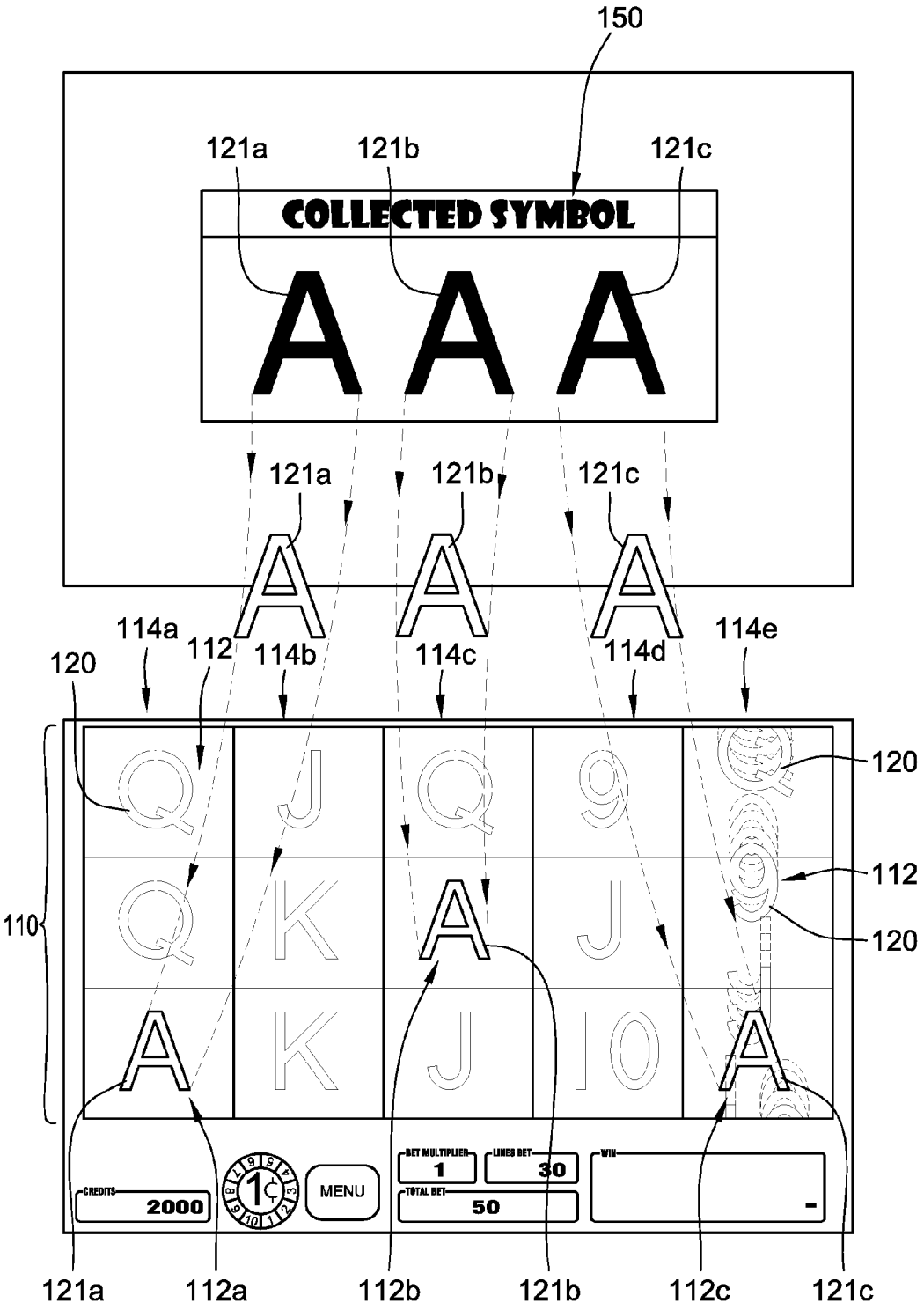

Referring to FIG. 5C, three collected symbols 121*a-c* are shown as having been collected in the symbol collection area 150. Thus, in the illustrated example, the selected symbol 120*a* was moved with respect to the array of symbol positions 110 three times during the play of the wagering game such that three of the selected symbols 120*a* were collected as collected symbols 121*a-c*. During the play of the wagering game, the collected symbols 121*a-c* are visually distributed among the array of symbol positions 110 such that each of the collected symbols 121*a-c* is associated with one of the symbol positions 112 for evaluation of a random outcome of the play of the wagering game. The collected symbols 121*a-c* can be randomly distributed among the symbol positions 112 and/or distributed according to one or more predetermined patterns.

As illustrated in FIG. 5C, a first one of the collected symbols 121*a* is distributed to a first symbol position 112*a*, a second one of the collected symbols 121*b* is distributed to a second symbol position 112*b*, and a third one of the collected symbols 121*c* is distributed to a third symbol position 112*c*. The distributed collected symbols 121*a-c* remain in the array of symbol positions 110 until an outcome of the wagering game is displayed. The outcome of the wagering game is displayed such that each of the symbol positions 112 is associated with a single one of the plurality of symbols 120 or the collected symbols 121*a-c*. Thus, the outcome of the wagering game includes all of the collected symbols 121*a-c*. While the distribution of the collected symbols 121*a-c* can occur prior to an entire outcome of the wagering game being displayed (i.e., while one or more reels continue to spin as shown in FIG. 5C), the distribution of one or more of the collected symbols 121*a-c* can occur after all of the reels stop spinning and an outcome is displayed (not shown).

The distribution of the collected symbols 121*a-c* can increase a player's anticipation and excitement when playing the wagering game. For example, in the case of the collected symbols 121*a-c* being high paying symbols or wild symbols, the distribution of the collected symbols 121*a-c* can positively affect the outcome of the wagering game by associating the collected symbols 121*a-c* with symbol positions 112 that cause a relatively higher paying award to be achieved as compared with the award that the player would have achieved without the collected symbols 121*a-c* being distributed.

In some aspects of the present disclosure, the collection of the selected symbols 120*a* can occur over the course of two or more plays of the wagering game. For example, instead of distributing the collected symbols 121*a-c* during the same play of the wagering game that the selected symbols 120*a* were initially collected (as described above in reference to FIGS. 5A-5C), the collected symbols 121*a-c* can be banked in the symbol collection area 150 such that they remain in the symbol collection area 150 for two or more plays of the wagering game before being distributed. Thus, a relatively larger number of selected symbols 120*a* can be collected, which can result in a relatively larger award when the collected symbols 121 are distributed.

In some aspects of the present disclosure, only a portion of the collected symbols 121 are distributed for a particular play of the wagering game. The number of the distributed ones of the collected symbols 121 can depend on one or more factors. For example, the number of distributed ones of the collected symbols 121 can be based on an amount of an initial wager made by the player of the wagering game. For another example, the number of distributed ones of the collected symbols 121 can be based on a player input during play of the wagering game (e.g., a player selects a number of collected symbols 121 to distribute). For yet another example, the number of distributed ones of the collected symbols 121 can be random and/or based on one or more trigger symbols (e.g., a "2" symbol indicating that two collected selected symbols are to be distributed) appearing during the spinning of the symbol-bearing reels.

Trigger to Collect Symbols

As described above in reference to FIGS. 5A-5C, in response to the selected symbol 120*a* appearing in the array of symbol positions 110 during the spinning of the symbol-bearing reels, the selected symbol 120*a* is visually collected in the symbol collection area 150. Alternatively, the selected symbols 120*a* are only collected after a trigger symbol or trigger symbols (not shown) appear in the array of symbol positions 110 during the spinning of the symbol-bearing reels a predetermined number of times (e.g., one time, twice, three times, etc.). That is, prior to the selected symbols 120*a* being visually collected in the symbol collection area 150, a trigger symbol or trigger symbols must be visually moved with respect to the array of symbol positions 110. The trigger symbol can be the same as the selected symbol 120*a*. In the case that the trigger symbol needs to appear only once to trigger the collection, in such instances, the first time the selected symbol appears it acts as the trigger and then the second time the selected symbol appears, and so on, it is collected as described herein.

Spinning/Moving Symbols Trigger Game Feature

Figure 6A:
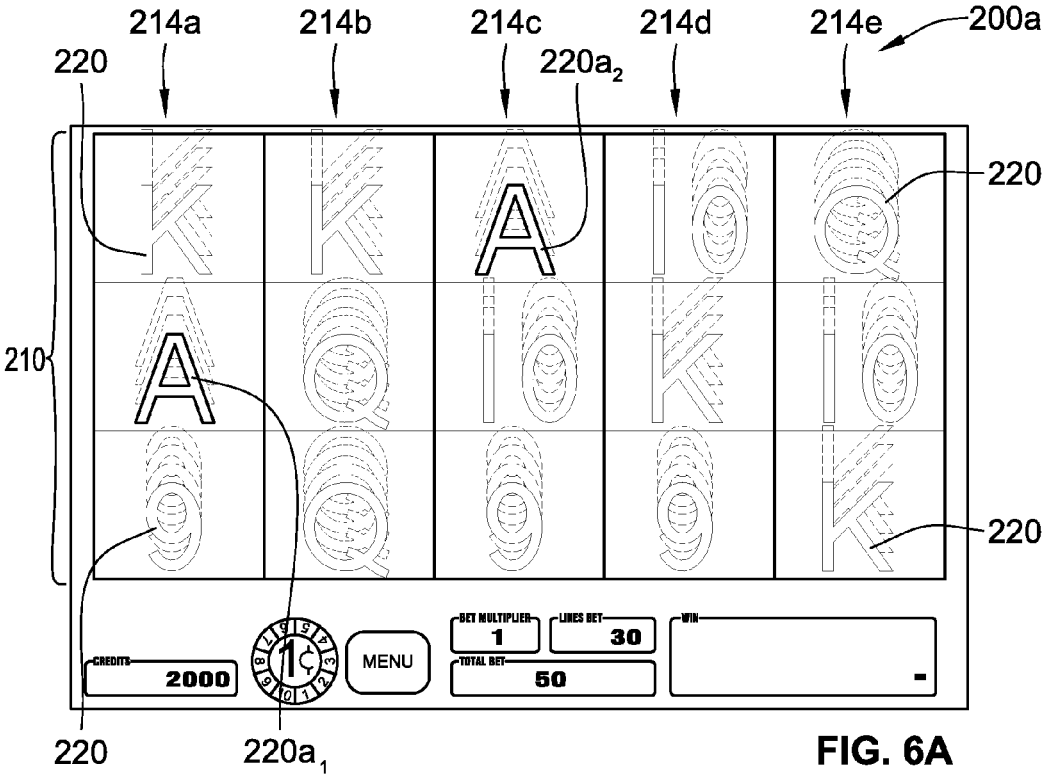
FIGS. 6A-6C are images of exemplary screens of a wagering game displayed on a gaming terminal according to some aspects of the present disclosure.
Figure 6B:
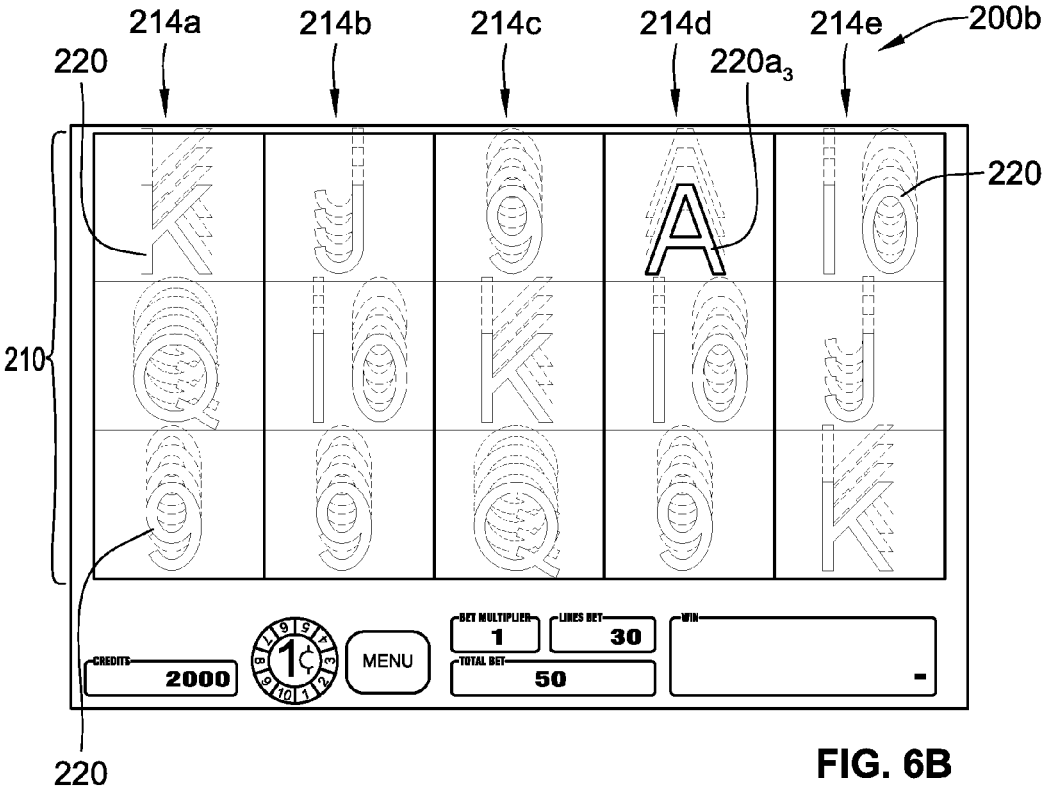
Figure 6C:
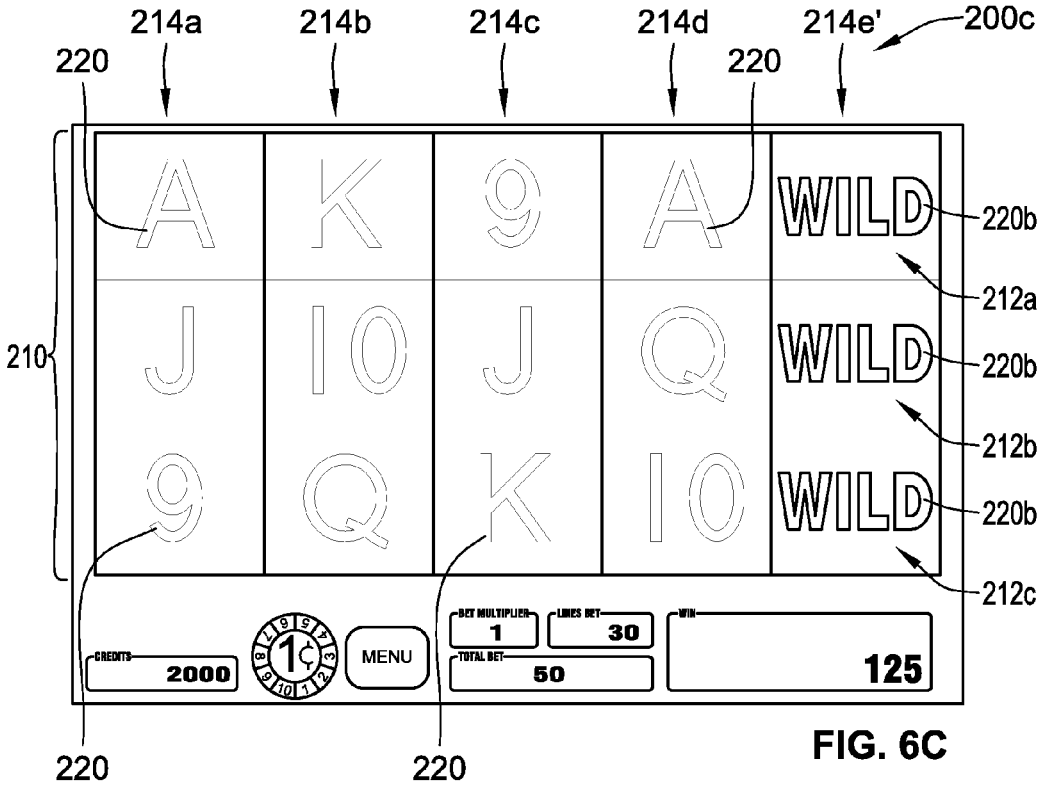

Referring to FIGS. 6A-6C, screenshots 200*a-c* of the primary display area 12 and/or the secondary display area 14 illustrate an array of symbol positions 210 used in conducting a wagering game is shown. The array of symbol positions 210 is the same as, or similar to, the array of symbol positions 110 described above. In response to receiving a wager to play the wagering game, a plurality of symbols 220 are moved with respect to the array of symbol positions 220 in the same, or similar, manner as described above in reference to FIGS. 4-5C (i.e., the symbol-bearing reels are spun).

Of the plurality of symbols 220, at least one is a trigger symbol $\mathbf{220}a_1$-$\mathbf{220}a_3$. As shown in the illustrated example, each of the "A" symbols is bolded to illustrate that each one is a trigger symbol $\mathbf{220}a_1$-$\mathbf{220}a_3$. The trigger symbols $\mathbf{220}a_1$-$\mathbf{220}a_3$ are used to trigger one or more game features. For example, in response to a predetermined number (e.g., one, two, three, etc.) of the trigger symbols $\mathbf{220}a_1$-$\mathbf{220}a_3$ being visually moved with respect to the array of symbol positions 210, a game feature is triggered. The predetermined number of trigger symbols $\mathbf{220}a_1$-$\mathbf{220}a_3$ can be visually moved during a single play of the wagering game, or alternatively, over a plurality of plays of the wagering game. The identity of the trigger symbols $\mathbf{220}a_1$-$\mathbf{220}a_3$ (e.g., "A" symbol, "K" symbol, etc.) can be fixed during play of the wagering game, randomly selected, or selectable from a plurality of player selectable elements by a player of the wagering game.

In the illustrated example of FIGS. 6A-6C, three trigger symbols $\mathbf{220}a_1$-$\mathbf{220}a_3$ are required to trigger the game feature of an all wild reel or column 214*e* (FIG. 6C). As shown in FIG. 6A, two trigger symbols $\mathbf{220}a_1$ and $\mathbf{220}a_2$ are initially present and being visually moved with respect to the array of symbol positions 210. In FIG. 6B, the two initial trigger symbols $\mathbf{220}a_1$ and $\mathbf{220}a_2$ are gone as the reels continued to spin and a third trigger symbol $\mathbf{220}a_3$ is present, which triggers the all wild column feature in the illustrated example. The fifth column 214*e* (FIGS. 6A and 6B) becomes an all wild column 214*e*' (FIG. 6C) in response to the third trigger symbol $\mathbf{220}a_3$ being visually moved with respect to the array of symbol positions 210. Specifically, the fifth column 214*e* (FIGS. 6A and 6B) is converted into an all wild column 214*e*' (FIG. 6C) such that each symbol position 212*a-c* of the all wild column 214*e*' is associated with a wild symbol 220*b*.

FIG. 6C also illustrates an outcome of the wagering game as all of the symbol-bearing reels have stopped spinning. The outcome includes all of the wild symbols 220*b* in the all wild fifth column 214*e*' of the array of symbol positions 210. While the fifth column 214 is described as becoming the all wild column 214*e*', one or more of the other columns 214*a-d* can become an all wild column in the same, or similar, manner. For example, the first and the third columns 214*a* and 214*c* can become all wild columns in response to six trigger symbols being visually moved with respect to the array of symbol positions 210 (not shown).

In addition to, or in lieu of, the trigger symbols 220*a* triggering an all wild column feature, the same, or different, trigger symbols can trigger one or more other types of game features in the same, or similar, manner. For example, the visual movement of one or more trigger symbols with respect to the array of symbol positions 210 can trigger a bonus game, a multiplier award/feature, a scatter pay feature, a wild symbol(s) feature, etc.

Figure 7A:
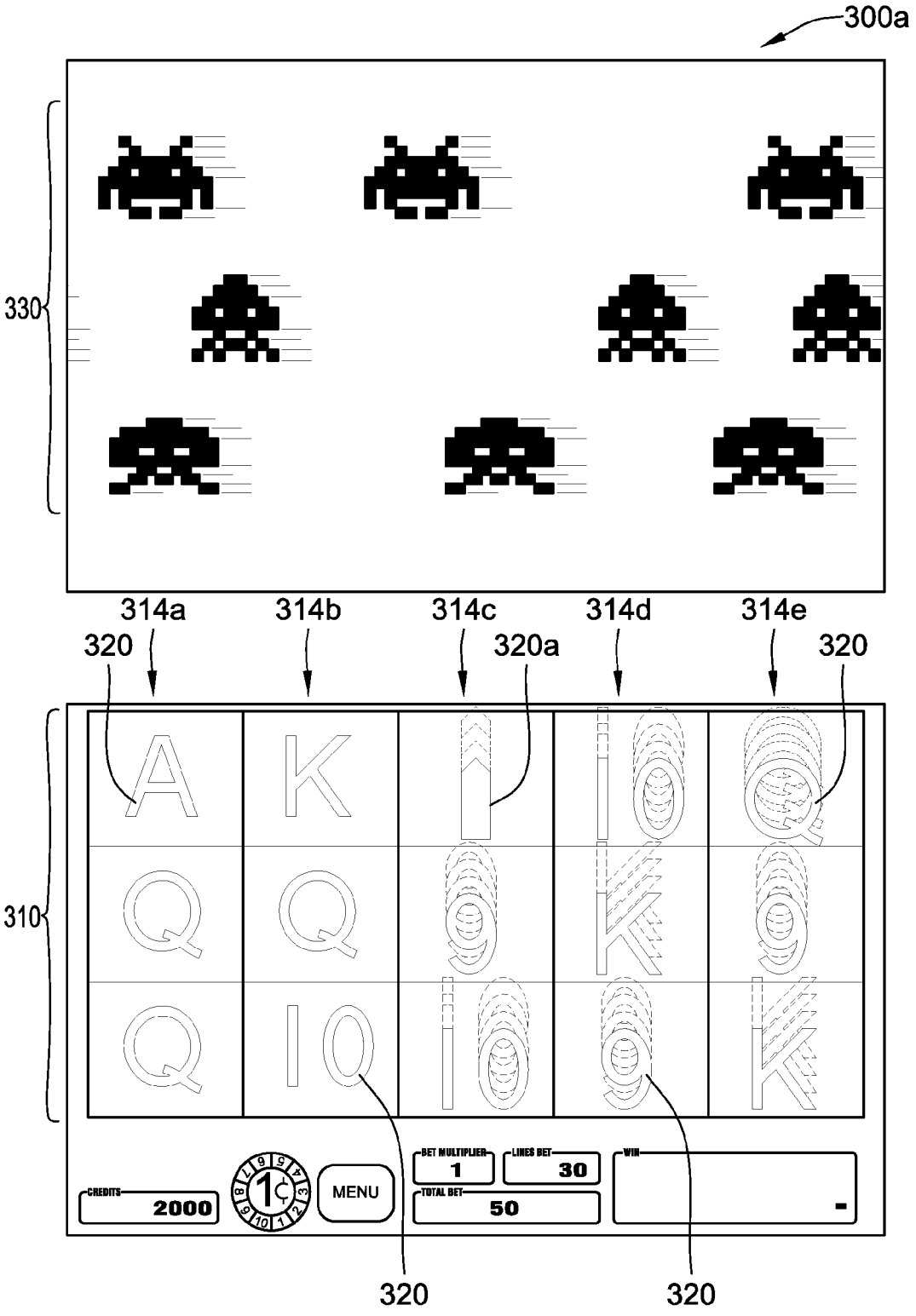
FIGS. 7A-7D are images of exemplary screens of a wagering game including a plurality of objects displayed above an array of symbol positions on a gaming terminal according to some aspects of the present disclosure.

Spinning/Moving Symbols Interacting with Objects Adjacent to Array of Symbol Positions Referring to FIG. 7A, a screen shot 300 from the primary display area 12 and/or the secondary display area 14 illustrates an array of symbol positions 310 and a plurality of objects 330 used in conducting a wagering game. The array of symbol positions 310 is the same as, or similar to, the array of symbol positions 110 described above. In response to receiving a wager to play the wagering game, a plurality of symbols 320 is moved with respect to the array of symbol positions 320 on the primary and/or secondary display areas 12, 14 in the same manner as described above in reference to FIGS. 4-5C (i.e., the symbol-bearing reels are spun).

As shown in FIG. 7A, the first and the second columns 314*a* and 314*b* of the five columns 314*a-e* have stopped spinning such that a portion of a random outcome is displayed. The remaining third, fourth, and fifth columns 314*c-e* remain spinning such that the symbols 320 are visually moving with respect to the array of symbol positions 310 in the third, fourth, and fifth columns 314*c-e*. The plurality of symbols 320 includes at least one bonus or special symbol 320*a*. In the illustrated example, the bonus symbol 320*a* is of the form of a rocket or missile, although the bonus symbol 320*a* can be of any shape, size, etc.

The plurality of objects 330 are displayed above the array of symbol positions 310. Alternatively, the objects 330 can be positioned anywhere on the primary display area 12 and/or the secondary display area 14 (e.g., above, below, sides, all around, etc. the array of symbol positions 310). Each of the plurality of objects 330 is visually moved with respect to the array of symbol positions 310 as the reels spin below. As shown, the objects 330 are being visually moved from right to left, although the objects can be visually moved in any direction (e.g., left to right, upward, downward, in a circle, randomly, etc.). The moving of the objects 330 causes each of the objects 330 to act as moving targets for the bonus symbols 320*a*, which act as target selection symbols.

Figure 7B:
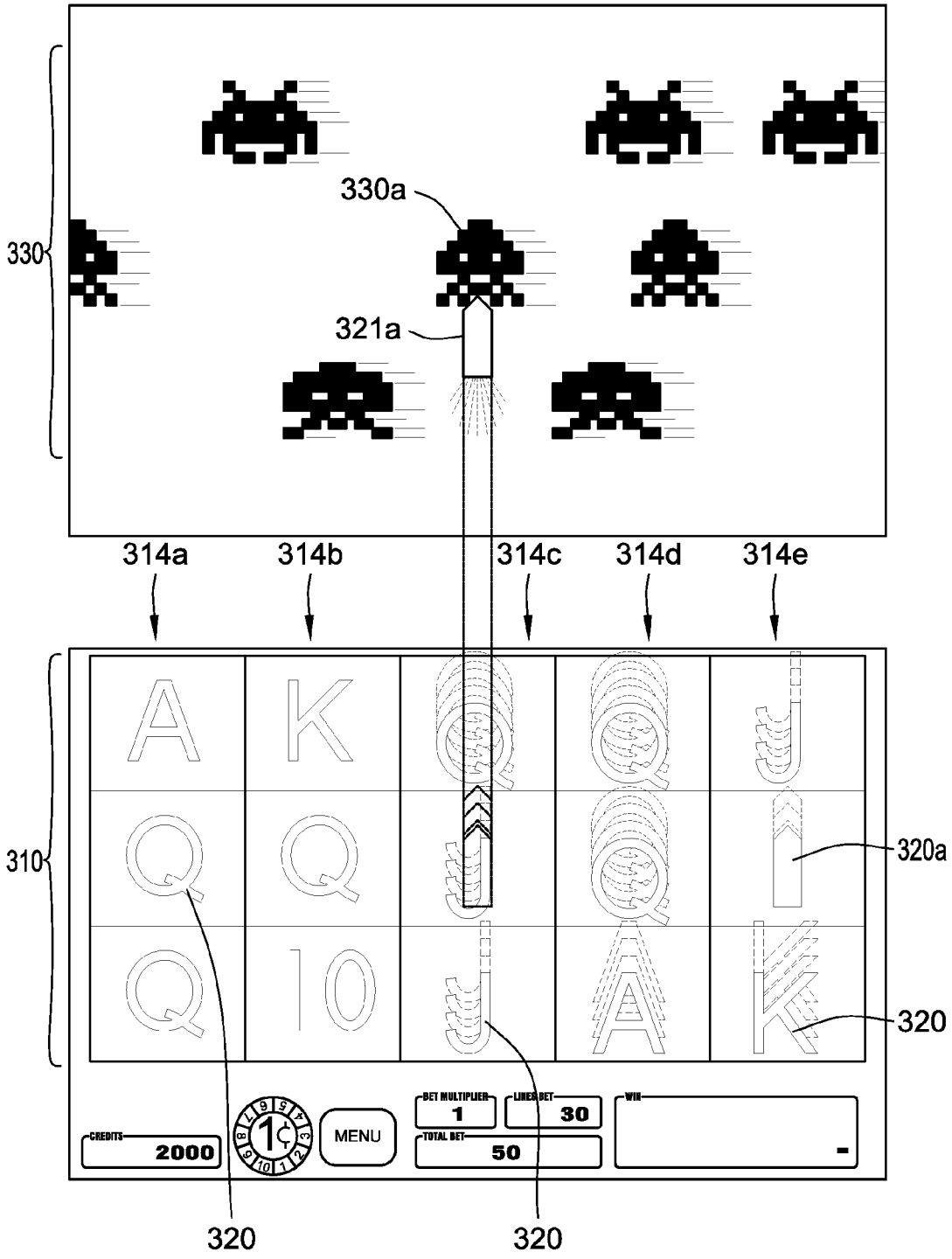

Specifically, as any of the reels that includes one of the bonus symbols 320*a* rotates such that the bonus symbol 320*a* is displayed, the bonus symbol 320*a* visually moves from the rotating symbol-bearing reel towards the objects 330. That is, in response to the bonus symbol 320*a* being displayed during the visual rotation of at least one of the symbol-bearing reels, the bonus symbol 320*a* visually moves or floats off of the reel and is visually moved towards the objects 330 as a moving bonus symbol 321*a*, as illustrated in FIG. 7B. As the bonus symbol 320*a* visually moves towards the objects 330, the moving bonus symbol 321*a* acts as a target selection symbol and randomly selects one of the objects 330 to target. One or more processors and/or controller (e.g., CPU 30) can randomly determine which, if any, of the objects 330 for the bonus symbol(s) to engage and which award to provide.

As shown in FIG. 7B, the moving bonus symbol 321*a* targeted object 330*a*. After the moving bonus symbol 321*a* selects/targets the object 330*a*, the moving bonus symbol 321*a* visually interacts with the object 330*a*. The visual interaction between the moving bonus symbol 321*a* and the targeted object 330*a* can result in hit or a miss.

Figure 7C:
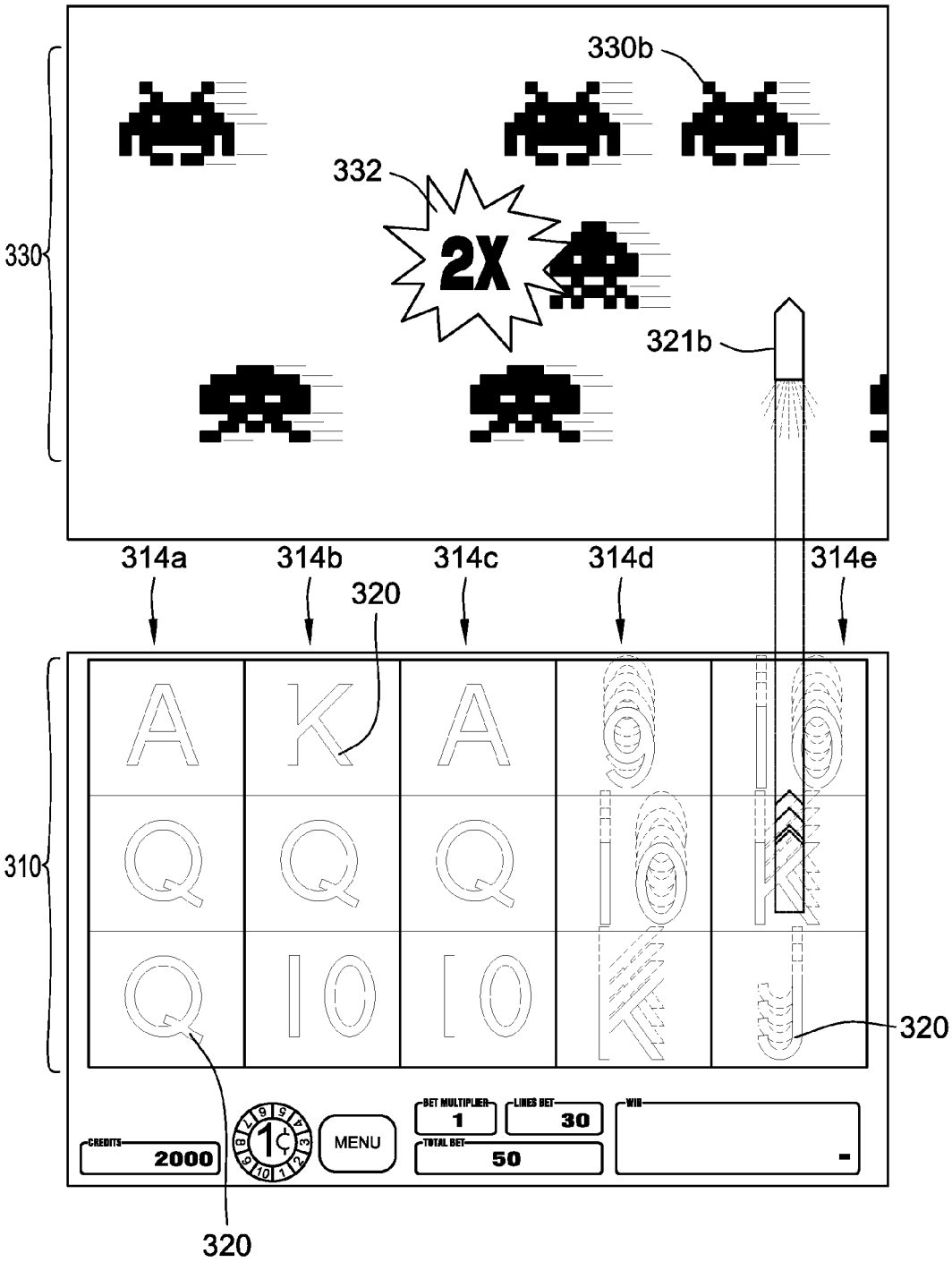

In the case of a hit, as illustrated in FIG. 7C, the moving bonus symbol 321*a* visually engages with the targeted object 330*a* such that an award 332 associated with the targeted object 330*a* is revealed to a player of the wagering game. While the illustrated award 332 is shown, for example, as a multiplier award, the award can also be credits, a bonus game trigger, one or more free plays of the wagering game, a scatter pay trigger, wild symbol(s) trigger, etc., or a combination thereof.

Figure 7D:
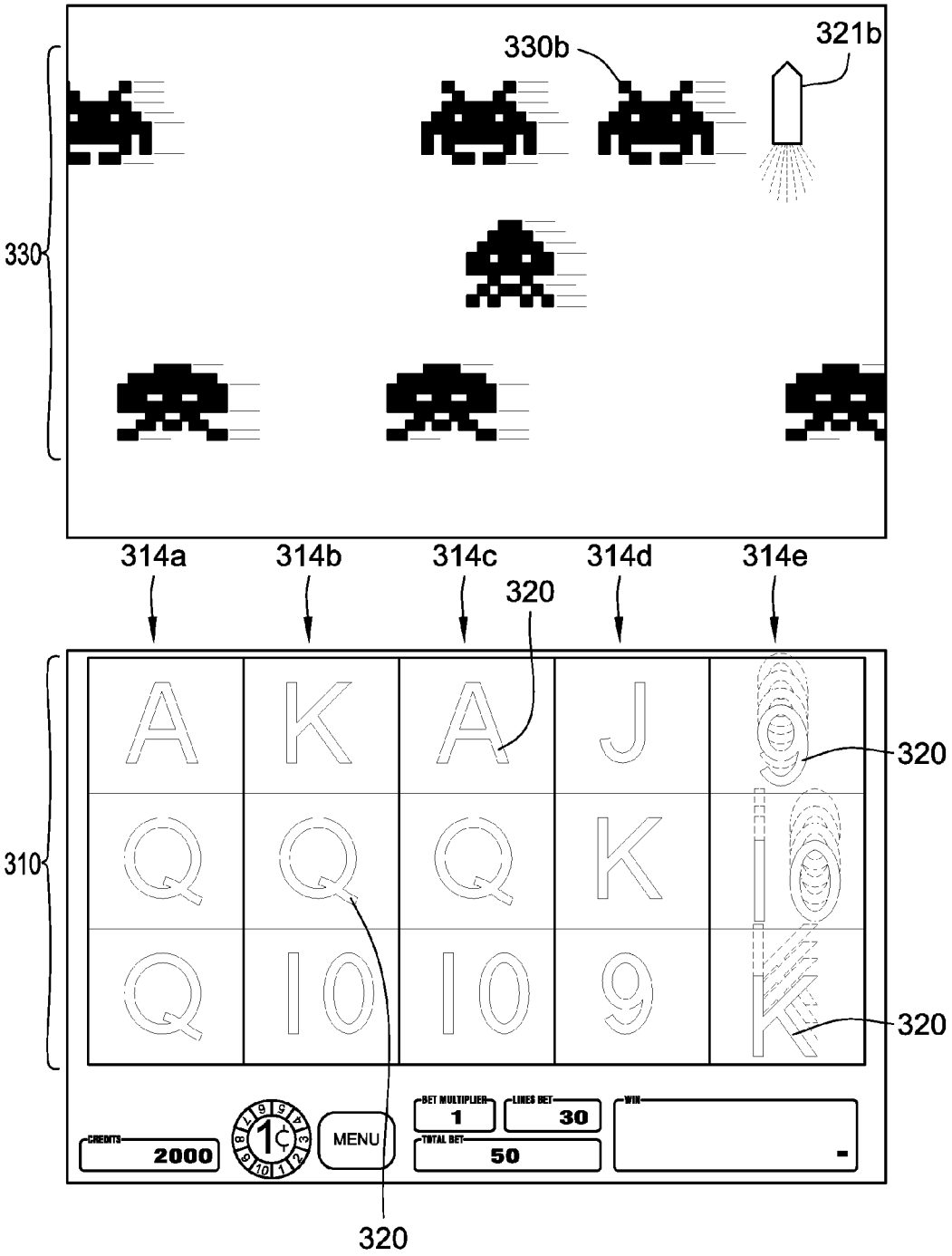

In the case of a miss, as illustrated in FIGS. 7C and 7D, a moving bonus symbol 321*b* visually engages with a targeted object 330*b* such that an award associated with the targeted object 330*b* is not revealed to a player of the wagering game (see FIG. 7D). Such a near miss of the moving bonus symbol 321*b* with the targeted object 330*b* can create additional anticipate and excitement for the player of the wagering game.

As described herein, the bonus symbols 320*a* can visually move off the reels and towards the objects 330 in response to being displayed during rotation of the reels. Alternatively, the bonus symbols 320*a* can visually move off the reels and towards the objects 330 in response to a predetermined number (e.g., one, two, three, etc.) of bonus symbols being displayed during the visual rotation of at least one of the symbol-bearing reels. That is, a trigger can be required prior to the bonus symbols 320*a* launching from the array of symbol positions 310 towards the objects 330.

Figure 8A:
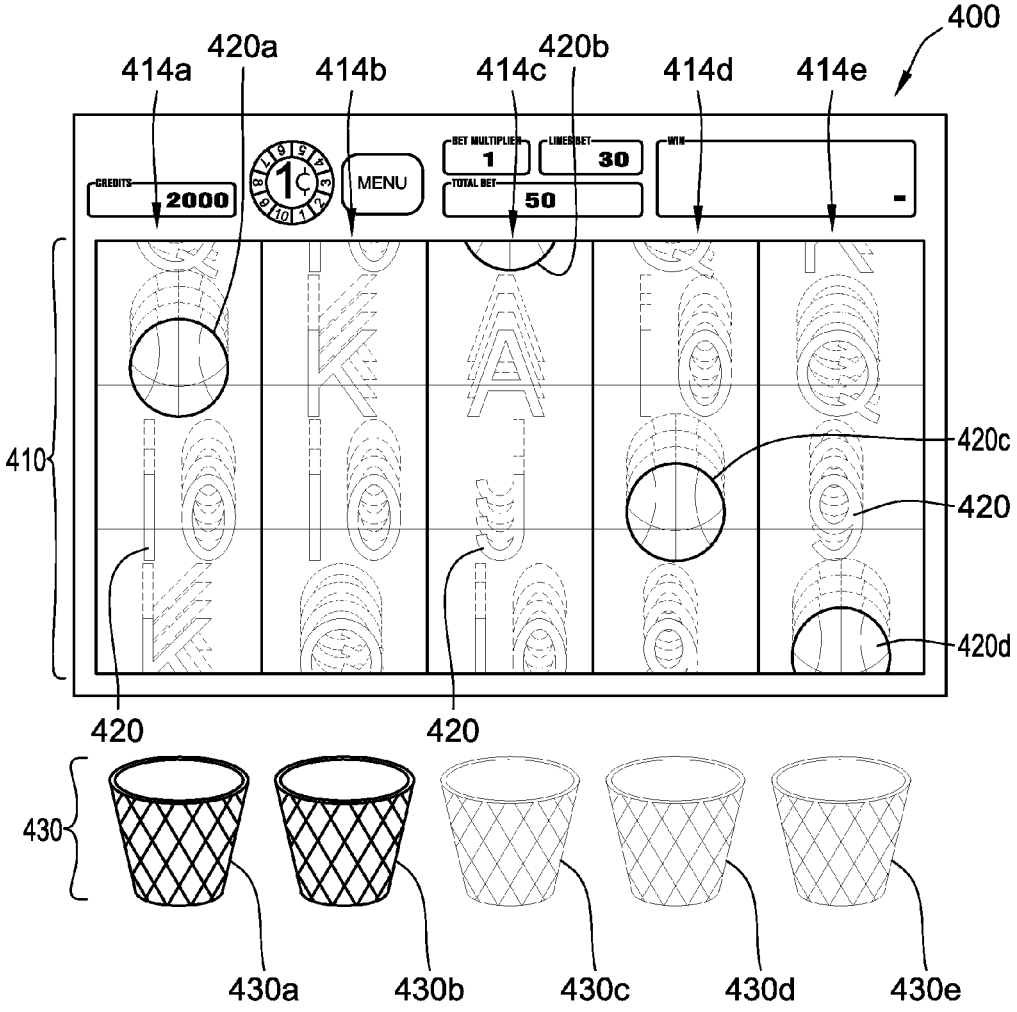
FIGS. 8A-8E are images of exemplary screens of a wagering game including a plurality of objects displayed below an array of symbol positions on a gaming terminal according to some aspects of the present disclosure.

Referring to FIG. 8A, a screen shot 400 from the primary display area 12 and/or the secondary display area 14 illustrates an array of symbol positions 410 and a plurality of objects 430 used in conducting a wagering game. The array of symbol positions 410 is the same as, or similar to, the array of symbol positions 110 described above. In response to receiving a wager to play the wagering game, a plurality of symbols 420 is moved with respect to the array of symbol positions 420 on the primary and/or secondary display areas 12, 14 in the same manner as described above in reference to FIGS. 4-5C (i.e., the symbol-bearing reels are spun).

The plurality of symbols 420 includes at least one bonus or special symbol 420*a-f* (see FIGS. 8A-8E). In the illustrated example, the bonus symbols 420*a-f* are of the form of balls, although the bonus symbols 420*a-f* can be of any shape, size, etc. (e.g., basketball, football, baseball, square, triangle, etc.).

The plurality of objects 430 are displayed below the array of symbol positions 410. Alternatively, the objects 430 can be positioned anywhere on the primary display area 12 and/or the secondary display area 14 (e.g., above, below, sides, all around, etc. the array of symbol positions 410). Each of the plurality of objects 430 is associated with a respective one of the columns 414*a-e*. Specifically, a first one of the objects 430*a* is associated with the first column 414*a*, a second one of the objects 430*b* is associated with the second column 414*b*, a third one of the objects 430*c* is associated with the third column 414*c*, a fourth one of the objects 430*d* is associated with the fourth column 414*d*, and a fifth one of the objects 430*e* is associated with the fifth column 414*e*.

The first and the second objects 430*a,b* are bolded as compared with the third, fourth, and fifth objects 430*c-e*, to illustrate that the first and the second objects 430*a,b* are active while the third, fourth, and fifth objects 430*c-e* are inactive. By active, it is meant that the first and the second objects 430*a, b* are at least displayed on the primary display area 12 and/or the secondary display area 14. Inactive objects (e.g., objects 430*c-e*) can be displayed in phantom or not displayed at all.

Objects 430 can be activated based on a player of the wagering game purchasing one or more of the objects 430 for use during play of the wagering game. Each object 430 can cost the same amount or each additional object can increase in price. For example, the first object 430*a* can cost 100 credits and the second object 430*b* can cost 200 credits. The player can purchase the objects 430 as a part of a wager to play the wagering game or as a separate input/payment. Purchased objects 430 can remain active for one or more plays of the wagering game.

In addition to, or in lieu of, purchasing the objects 430, one or more of the objects 430 can be awarded based on one or more bonus symbols being displayed during rotation of at least one of the symbol-bearing reels (e.g., one or more of the bonus symbols 420*a-f* visually moving with respect to the array of symbol positions). For example, in response to three of the bonus symbols 420*a-f* being spun through the array of symbol positions 410 during rotation of the symbol-bearing reels, one or more of the objects 430*a-e* can be awarded (i.e., activated) for use during that play of the wagering game and/or during subsequent plays of the wagering game.

Similarly, in addition to, or in lieu of, purchasing the objects 430, one or more objects 430 can be awarded based on one or more outcomes of the wagering game. For example, in response to a player achieving an outcome including one or more bonus symbols (e.g., bonus symbols 420*a-f*), one or more of the objects 430*a-e* can be awarded to the player for use during subsequent plays of the wagering game.

Figure 8B:
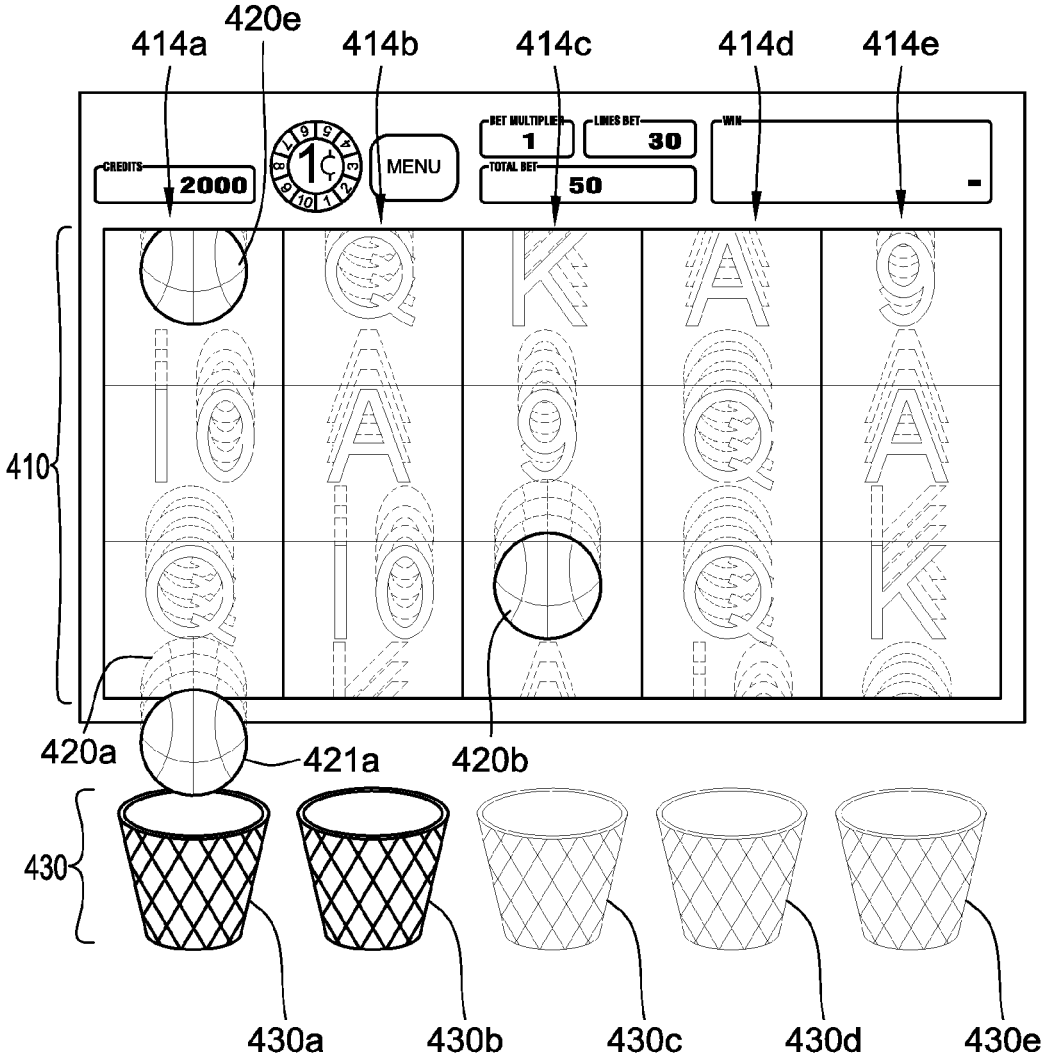

Referring to FIG. 8B, in response to a column having an associated active object (e.g., the first column 414*a*, which is associated with active object 430*a*; and the second column 414*b*, which is associated with active object 430*b*) and as any of the reels that includes one of the bonus symbols 420*a-f* rotates such that the bonus symbol 420*a-f* is displayed, the bonus symbol 420*a-f* visually moves from the rotating symbol-bearing reel towards the objects 430*a-e*. For example, as illustrated in FIG. 8B, in response to the bonus symbol 420*a* being displayed during the visual rotation of the symbol-bearing reel occupying the first column 414*a*, the bonus symbol 420*a* visually moves or floats off of the reel and is visually moved towards the first object 430*a* as a moving bonus symbol 421*a*.

After the moving bonus symbol 421*a* moves off the reel, the moving bonus symbol 421*a* visually interacts with the object 430*a* associated with the column 414*a* initially containing the associated bonus symbol 420*a*. The visual interaction between the moving bonus symbol 421*a* and the associated active object 430*a* can result in a standard score, a miss, or a compound-score.

Figure 8C:
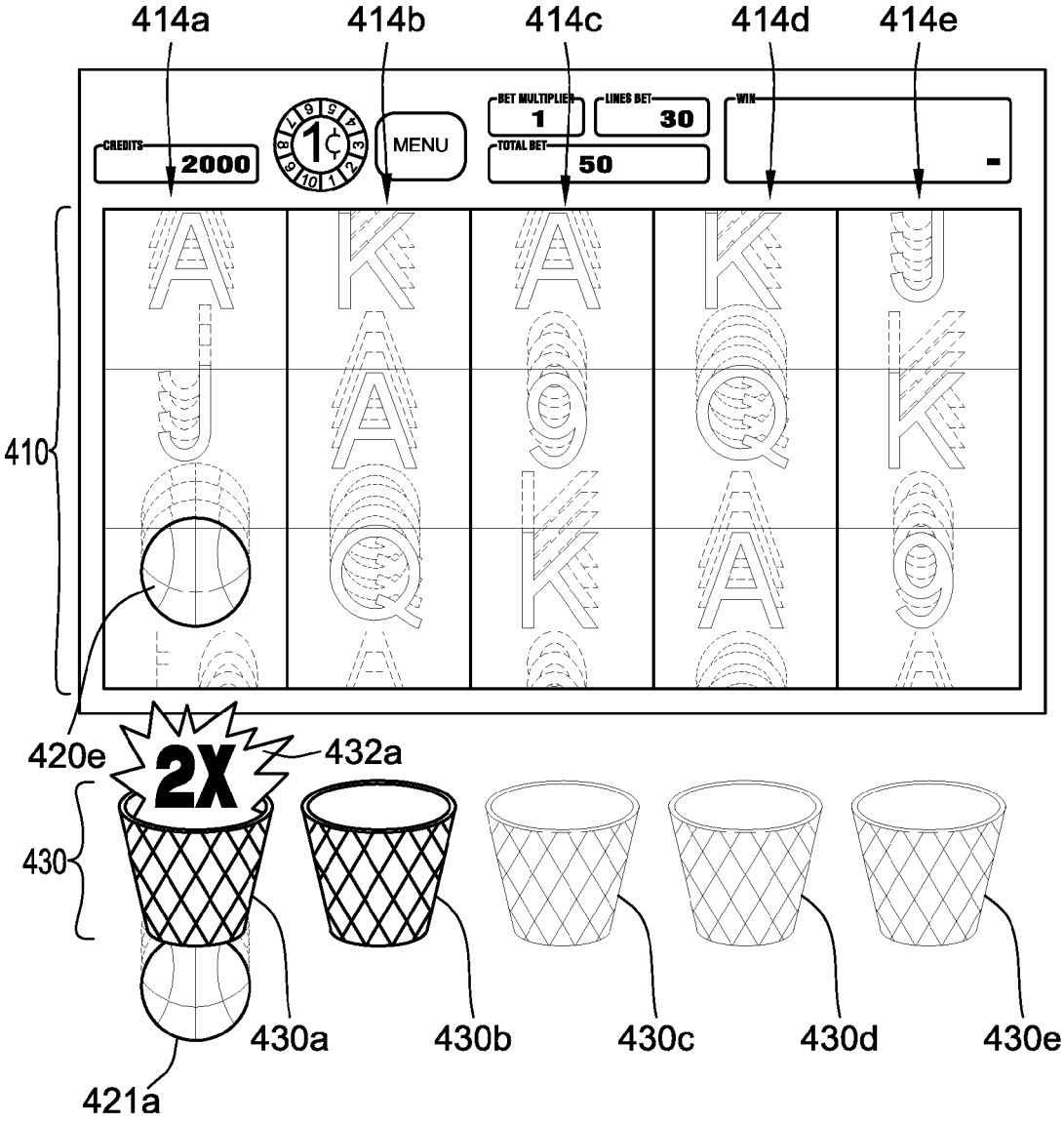

In the case of a standard-score, as illustrated in FIG. 8C, the moving bonus symbol 421*a* visually engages with the associated active object 430*a* such that an award 432*a* associated with the associated active object 430*a* is revealed to a player of the wagering game. While the illustrated award 432*a* is shown, for example, as a multiplier award, the award can also be credits, a bonus game trigger, one or more free plays of the wagering game, a scatter pay trigger, wild symbol(s) trigger, etc., or a combination thereof.

In the case of a miss (not shown), the moving bonus symbol 421*a* visually engages with the associated active object 430*a* such that the award 432*a* associated with the object 430*a* is not revealed to a player of the wagering game. For example, instead of the moving bonus object 421*a* going through the object 430*a* (e.g., the basket was made) as shown in FIG. 8C, the moving bonus object 421*a* can visually interact with the object 430*a* such that it visually bounces off the object 430*a* and is not visually moved through the object 430*a* (e.g., the basket is missed). Such interaction of the moving bonus symbol 421*a* with the object 430*a* illustrates a near miss that can create anticipation and excitement for the player of the wagering game.

Figure 8D:
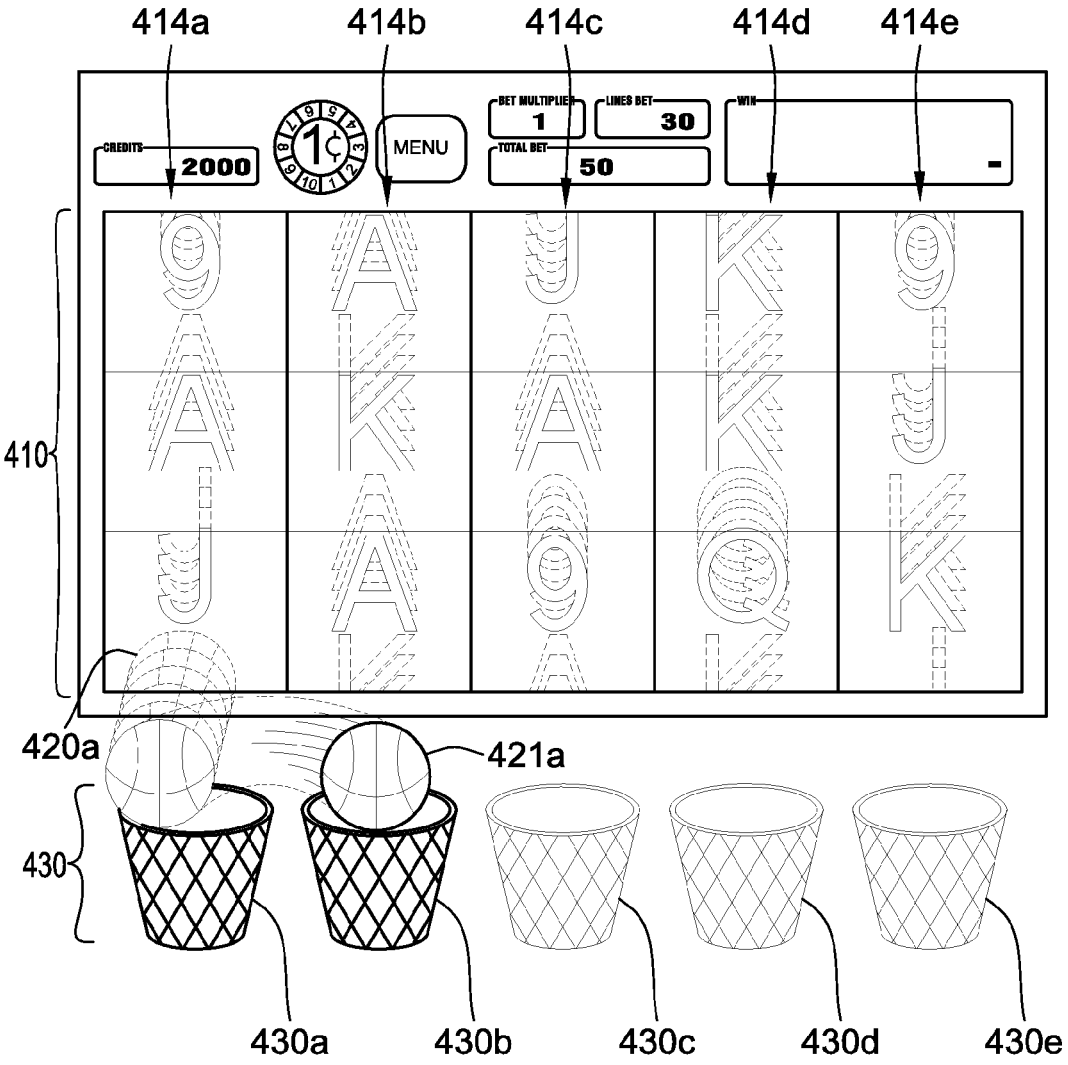
Figure 8E:
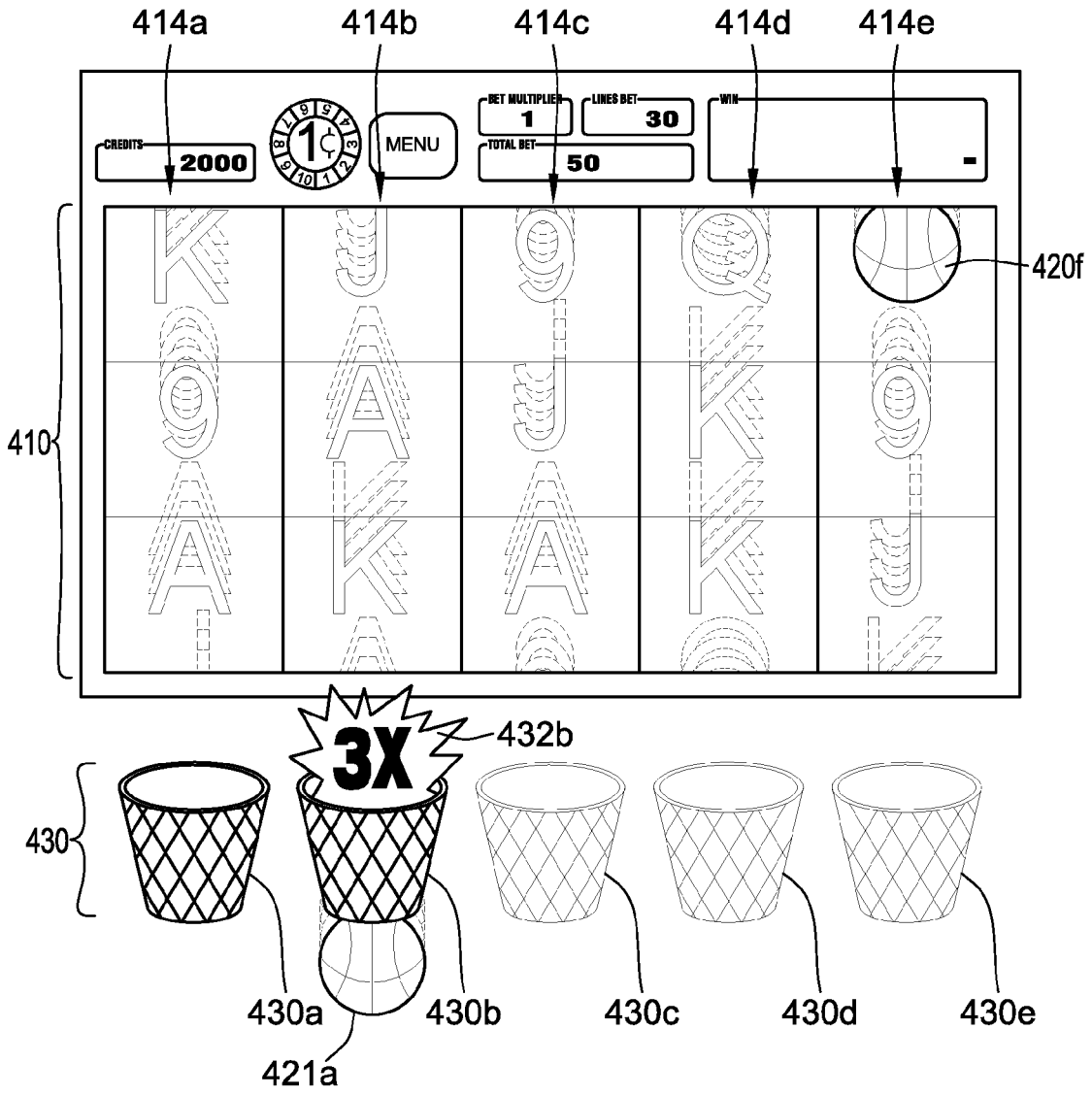

In the case of a compound-score, as illustrated in FIGS. 8D and 8E, the moving bonus symbol 421*a* initially visually engages with the associated active object 430*a* such that the moving bonus symbol 421*a* visually bounces off the object 430*a* (i.e., appears to be a miss); however, instead of bouncing off as a miss, the moving bonus symbol 421*a* bounces such that it then visually interacts with a different one of the objects 430*a-e*. For example, the moving bonus symbol 421*a* visually interacts with the second object 430*b* (FIG. 8D) such that an award 432*b* (FIG. 8E) associated with the second object 430*b* is revealed to a player of the wagering game.

The award 432*b* associated with the second object 430*b* can be the same as or different than the award 432*a* associated with the first object 430*a*. For example, as shown, the award 432*b* associated with the second object 430*b* is a 3× multiplier which is larger or greater than the 2× multiplier award 432*a* associated with the first object 430*a*. Thus, the compound-score illustrated in FIGS. 8D and 8E can create anticipation and excitement as the potential awards can increase as compared with the award associated with other active objects that the player might have achieved without the compound interaction described herein.

Alternatively to the compound-score illustrated in FIG. 8E, the visual interaction between the moving bonus symbol 421*a* and the second object 430*b* illustrated in FIG. 8D can result in a miss (not shown), where the moving bonus symbol 421*a* interacts with the second object 430*b* such that the award 432*b* is not achieved and/or displayed to the player. Similarly, the visual interaction between the moving bonus symbol 421*a* and the second object 430*b* illustrated in FIG. 8D can result in a multi-compound-score, where the moving bonus symbol 421*a* then interacts with another one of the objects (e.g., objects 430*c-e*) after first interacting with the first and the second objects 430*a,b* (not shown).

As described herein, the bonus symbols 420*a-f* can visually move off the reels and towards the objects 430*a-e* in response to being displayed during rotation of the reels. Alternatively, the bonus symbols 420*a-f* can visually move off the reels and towards the objects 430*a-e* in response to a predetermined number (e.g., one, two, three, etc.) of bonus symbols being displayed during the visual rotation of at least one of the symbol-bearing reels. That is, a trigger can be required prior to the bonus symbols 420*a-f* launching from the array of symbol positions 410 towards the objects 430*a-e*.

Figure 9A:
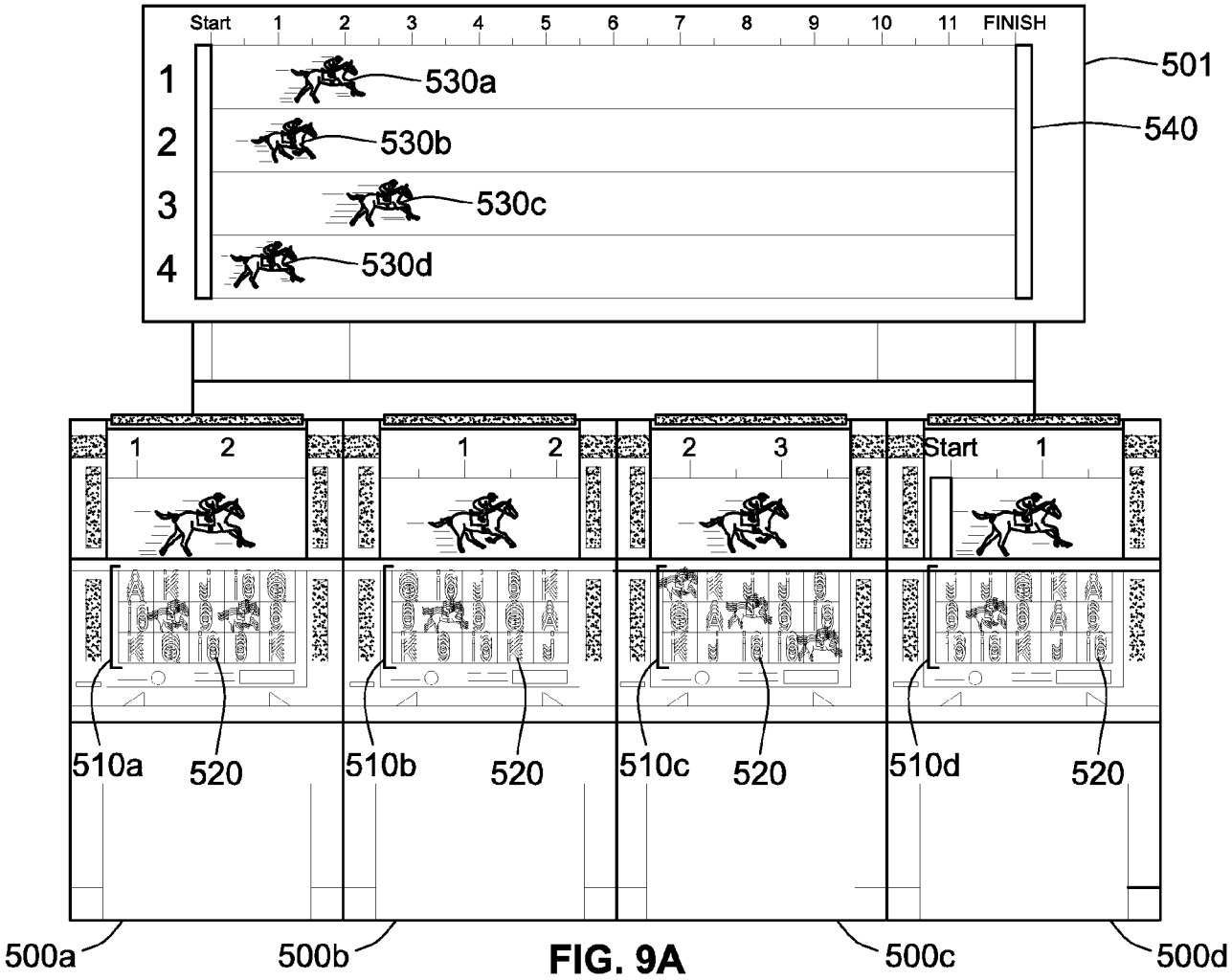
FIG. 9A is a community wagering game including a plurality of gaming terminals and a community display device according to some aspects of the present disclosure.
Figure 9B:
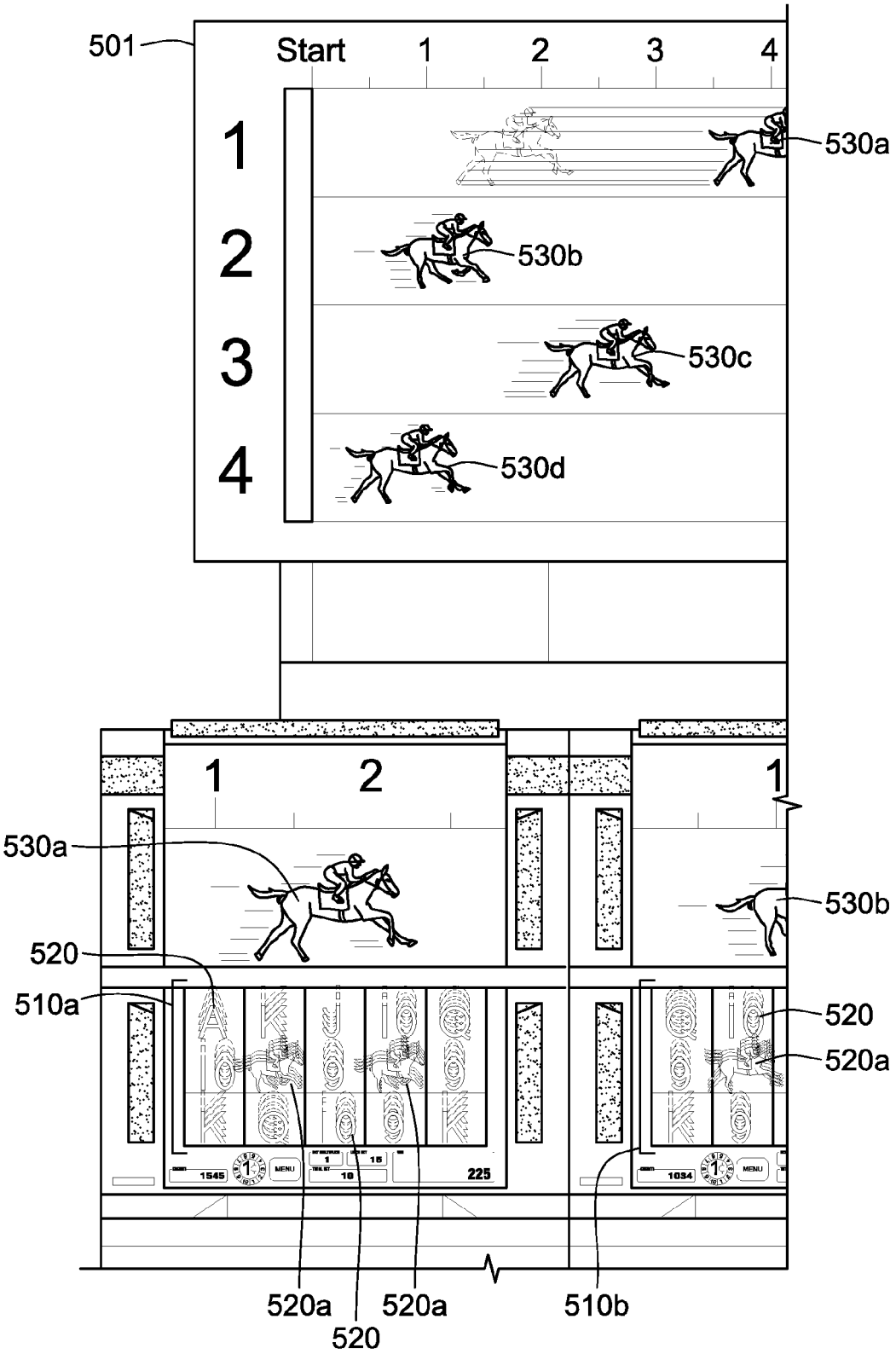
FIG. 9B is an enlarged portion of the community wagering game of FIG. 9A.

Incrementing Community-Bonus Symbols when Trigger Symbol(s) is Displayed During Rotation of Reels Referring to FIGS. 9A and 9B, a community wagering game including a plurality of gaming terminals 500*a-d* and a community display device 501 is shown. Each of the gaming terminals 500*a-d* is the same as, or similar to, the gaming terminal 10 shown in FIG. 1 and described herein. Thus, each of the gaming terminals 500*a-d* includes respective primary and secondary display areas (e.g., primary and secondary display areas 12 and 14 shown in FIG. 1) for displaying respective arrays of symbol positions 510*a-d* used in conducting a wagering game. Each respective array of symbol positions 510*a-d* is the same as, or similar to, the array of symbol positions 110 described above. In response to receiving a wager to play the wagering game, a plurality of symbols 520 is moved with respect to each array of symbol positions 520*a-d* in the same, or similar, manner as described above in reference to FIGS. 4-5C (i.e., the symbol-bearing reels are spun).

Of the plurality of symbols 520, at least one is a trigger symbol 520*a*. When one of the trigger symbols 520*a* appears in the array of symbol positions (e.g., array of symbol positions 510*a-d*) during the spinning of the symbol-bearing reels (i.e., the trigger symbol is visually moved with respect to the array of symbol positions), a community-bonus symbol (e.g., community-bonus symbols 530*a-d*) displayed on the community display device 501 corresponding to the gaming terminal displaying the moving trigger symbol 520*a* is visually incremented.

For example, as shown in FIG. 9B, which is an enlarged portion of FIG. 9A for better clarity, two trigger symbols 520*a* are displayed on the first gaming terminal 500*a* during the spinning of the symbol-bearing reels. Thus, the community-bonus symbol 530*a* corresponding to the first gaming terminal 500*a* is incremented twice (once for each of the trigger symbols 520*a*), which is illustrated by the community-bonus symbol 530*a* moving from a first position near a "2" mark to a "4" mark on the community display device 501. Similarly, in response to one or more trigger symbols 520*a* appearing on one of the other gaming terminals 500*b-d* during the spinning of the respective symbol-bearing reels, a respective one of the community-bonus symbols 530*b-d* is visually incremented.

As each one of the community-bonus symbols 530*a-d* is incremented, it visually moves closer to a target or finish line 540. The player of the gaming terminal 500*a-d* associated with the first one of the community-bonus symbols 530*a-d* to reach the finish line 540 is awarded a community bonus award, such as, for example, credits, multiplier, bonus game trigger, free plays, scatter pay, etc. That is, the first one of the gaming terminals 500*a-d* to have a predetermined number of trigger symbols 520*a* (e.g., 12) spun through its respective array of symbol positions 510*a-d* will cause the associated community-bonus symbol 530*a-d* to visually increment enough times to be the first one to reach the finish line 540.

Reaching the finish line 540 can take a plurality of plays of the wagering game. For example, it might take a player of the first gaming terminal 500*a* fifty plays of the wagering game before enough of the trigger symbols 520*a* spin through the first array of symbol positions 510*a* to visually increment the first community-bonus symbol 530*a* such that it visually interacts with and/or engages the finish line 540. After a first one of the community-bonus symbols 530*a-d* is visually incremented such that it reaches and/or interacts with the finish line 540, each of the community-bonus symbols 530*a-d* is automatically moved backed to a starting position. Alternatively, after a first one of the community-bonus symbols reaches the finish line 540, only the first one of the community-bonus symbols is moved backed to the starting position, while the rest of the community-bonus symbols maintain their current position on the community display device 501.

Spinning/Moving Symbol Floats Off Reel and Causes Array to Expand and/or Shrink

Figure 10A:
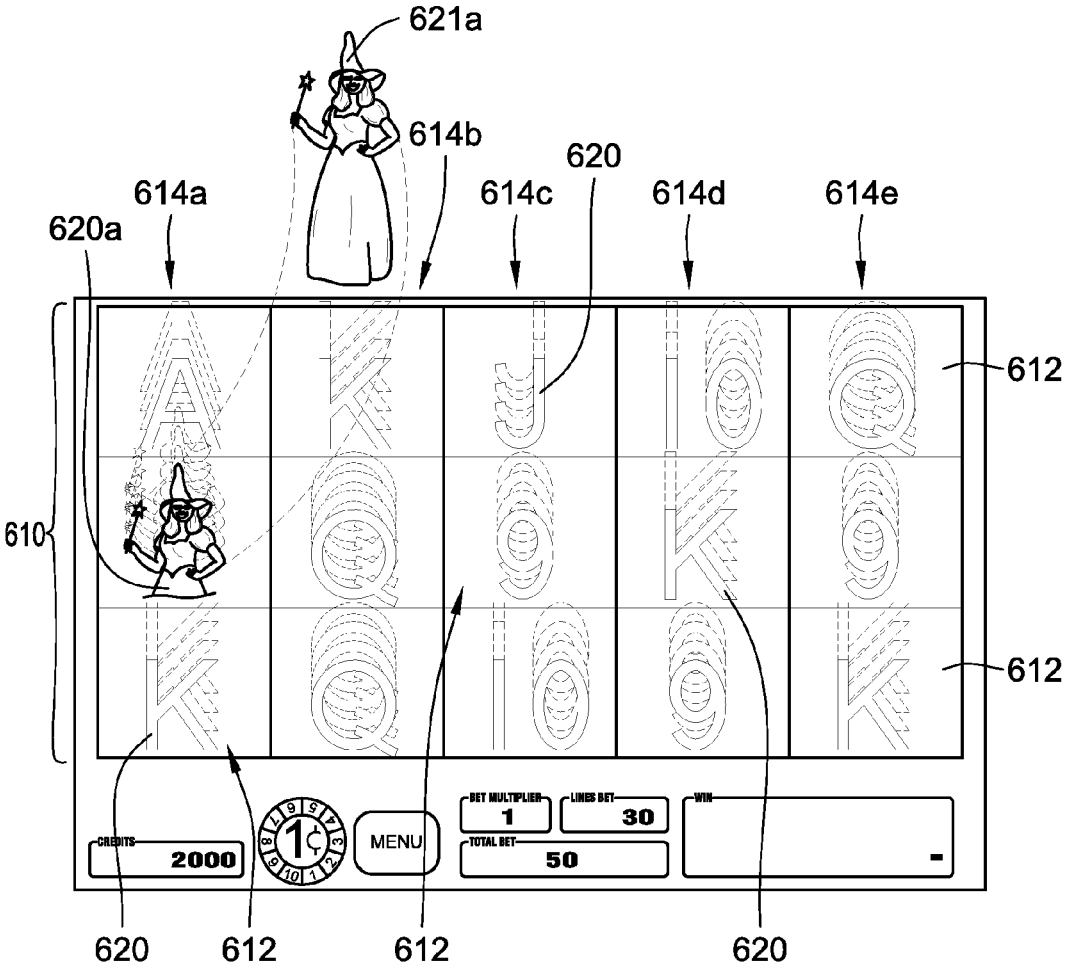
FIGS. 10A-10D are images of exemplary screens of a wagering game including an array-expansion symbol for expanding an array of symbol positions on a gaming terminal according to some aspects of the present disclosure.

Referring to FIG. 10A, the primary display area 12 and/or the secondary display area 14 displays a base array of symbol positions 610 including five columns 614*a-e* used in conducting a wagering game. The base array of symbol positions 610 is the same as, or similar to, the array of symbol positions 110 described above. In response to receiving a wager to play the wagering game, a plurality of symbols 620 is moved with respect to the base array of symbol positions 610 in the same, or similar, manner as described above in reference to FIGS. 4-5C (i.e., the symbol-bearing reels are spun).

Of the plurality of symbols 620, at least one is an array-expansion symbol 620*a*. As shown in FIG. 10A, the "Good Witch" symbol spinning on the symbol-bearing reel in the first column 614*a* of the base array of symbol positions 610 is bolded to illustrate that it is array-expansion symbol 620*a*. The array-expansion symbol 620*a* is used to visually cause the base array of symbol positions 610 (FIG. 10A) to expand into an expanded array of symbol positions 610' (shown in FIGS. 10C and 10D) prior to a final outcome (displayed in FIG. 10D) of the wagering game being displayed.

Figure 10B:
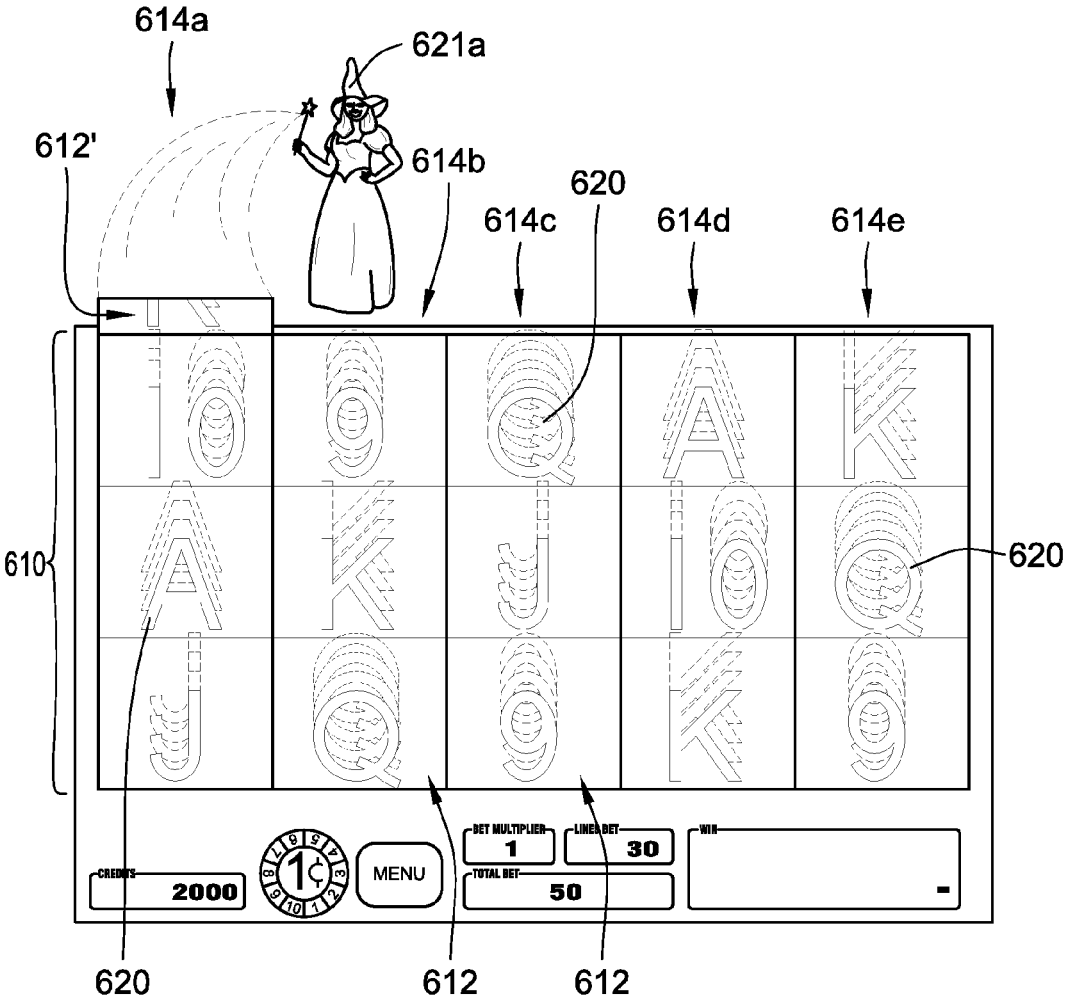
Figure 10C:
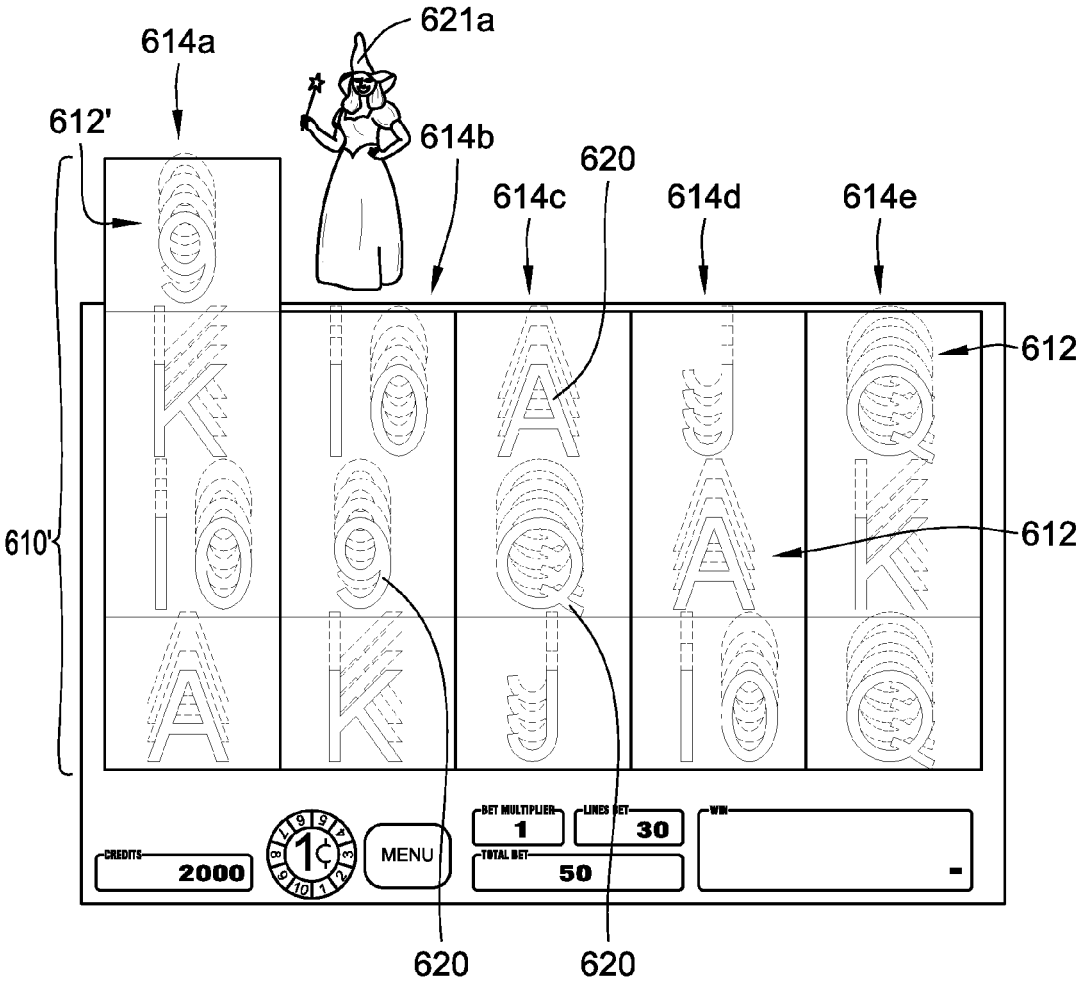

For example, in response to the array-expansion symbol 620*a* appearing in the base array of symbol positions 610 (FIG. 10A) during the spinning of the symbol-bearing reels (i.e., the array-expansion symbol 620*a* is visually moved with respect to the base array of symbol positions 610), the base array of symbol positions 610 (FIG. 10A) is expanded (partial expansion shown in FIG. 10B) into the expanded array of symbol positions 610' (FIGS. 10C and 10D) to include at least one additional symbol position 612'. Additionally, in response to the array-expansion symbol 620*a* being spun through the base array of symbol positions 610, the array-expansion symbol 620*a* visually moves or floats off of the symbol-bearing reel in the first column 614*a* and is displayed adjacent to (e.g., above, below, side), or at least partially on (not shown), the base array of symbol positions 610 as an array-expansion feature 621*a*, as illustrated in FIG. 10A. The array expansion feature 621*a* visually causes the base array of symbol positions 610 (FIG. 10A) to expand into the expanded array of symbol positions 610' (FIGS. 10B and 10C). As shown in FIG. 10C, after the base array of symbol positions 610 is expanded, at least one of the reels continues to spin prior to displaying a final outcome of the wagering game (FIG. 10D).

In the illustrated example of FIGS. 10A-10D, one array-expansion symbol 620*a* is required to cause the base array of symbol positions 610 to expand from a 3×5 array including twelve symbol positions 612 to the expanded array of symbol positions 610' including thirteen symbol positions including the twelve original symbol positions 612 and one additional symbol position 612'. Alternatively, two or more array-expansion symbols 620*a* can be required to first spin through the base array of symbol positions 610 prior to one of the array-expansion symbols 620*a* floating off one of the reels to cause the base array of symbol positions 610 to visually expand into an expanded array of symbol positions (e.g., the expanded array of symbol positions 610'). Additionally, the base array of symbol positions 610 can be expanded two or more times during a single play of the wagering game by one or more array-expansion symbols 620*a* in the same, or similar, manner.

Figure 10D:
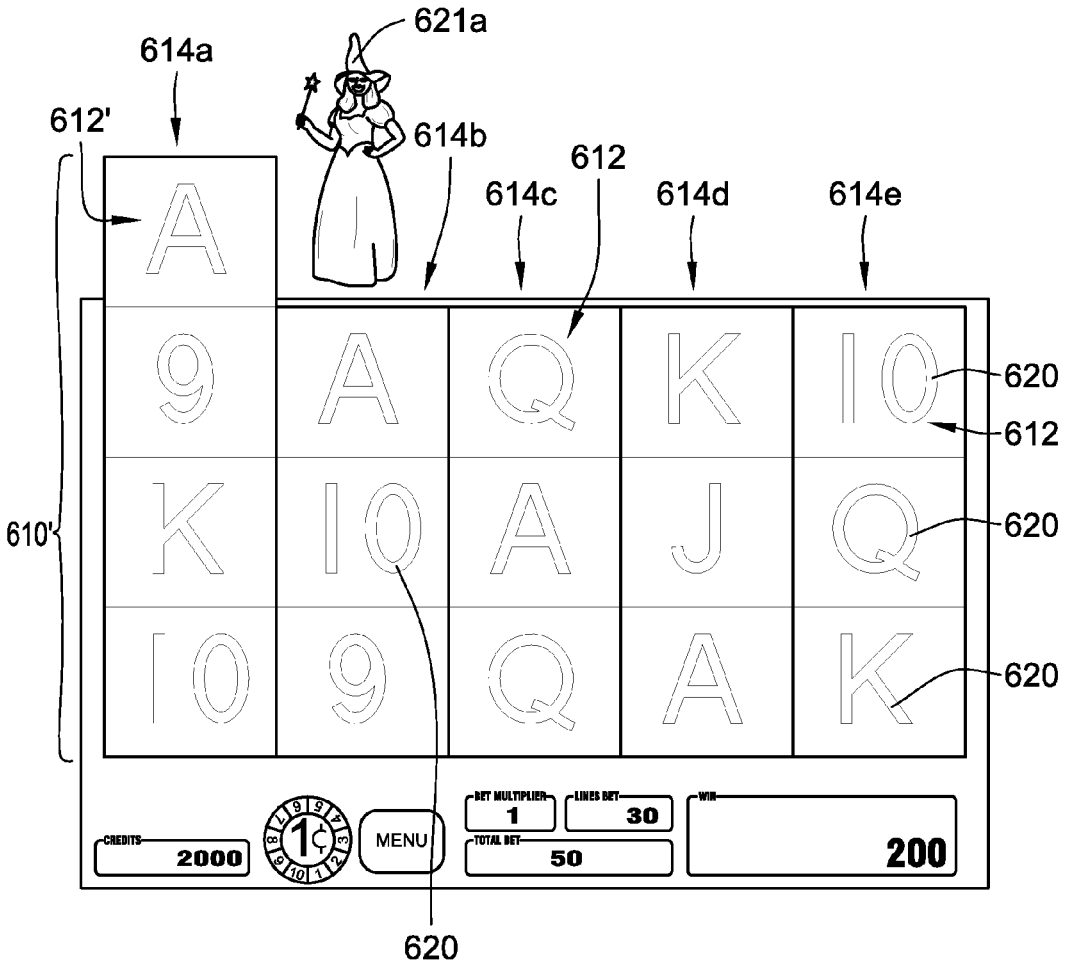

FIG. 10D illustrates an outcome of the wagering game as all of the symbol-bearing reels have stopped spinning. The outcome includes one of the symbols 620 being associated with each of the symbol positions (612 and 612') in the expanded array of symbol positions 610'. While the expanded array of symbol positions 610' is shown and described as including only one additional symbol position 612' added to the top of the first column 614*a*, one or more of the other columns 614*b-e* can include one or more additional symbol positions (not shown) in the expanded array of symbol positions 610' in the same, or similar, manner. For example, one or more array-expansion symbols 620*a* can visually cause the first, the third, and the fifth columns 614*a,c,e* to include two additional symbol positions in response to the one or more array-expansion symbols 620*a* being visually spun through the base array of symbol positions 610 (not shown).

As the expanded array of symbol positions 610' (FIGS. 10C and 10D) includes more symbol positions than the base array of symbol positions 610 (FIG. 10A), the expanded array of symbol positions 610' has more ways for a player of the wagering game to win the wagering game and thus provides added excitement to the player. For example, the base array of symbol positions 610 includes 5 columns 614*a-e* with three symbol positions 612 in each column, which has two hundred and forty-three ways to win (3×3×3×3×3=243), assuming a winning outcome must start from the leftmost column 614*a* and must include a single symbol from each of the columns 614*a-e*. However, the expanded array of symbol positions 610' includes 5 columns 614*a-e* with four symbol positions in the first column 614*a* and three symbol positions in the second, third, fourth, and fifth columns 614*b-e*, which has three hundred twenty-four ways to win (4×3×3×3×3=324), assuming again a winning outcome must start from the leftmost column 614*a* and must include a single symbol from each of the columns 614*a-e*.

Figure 11A:
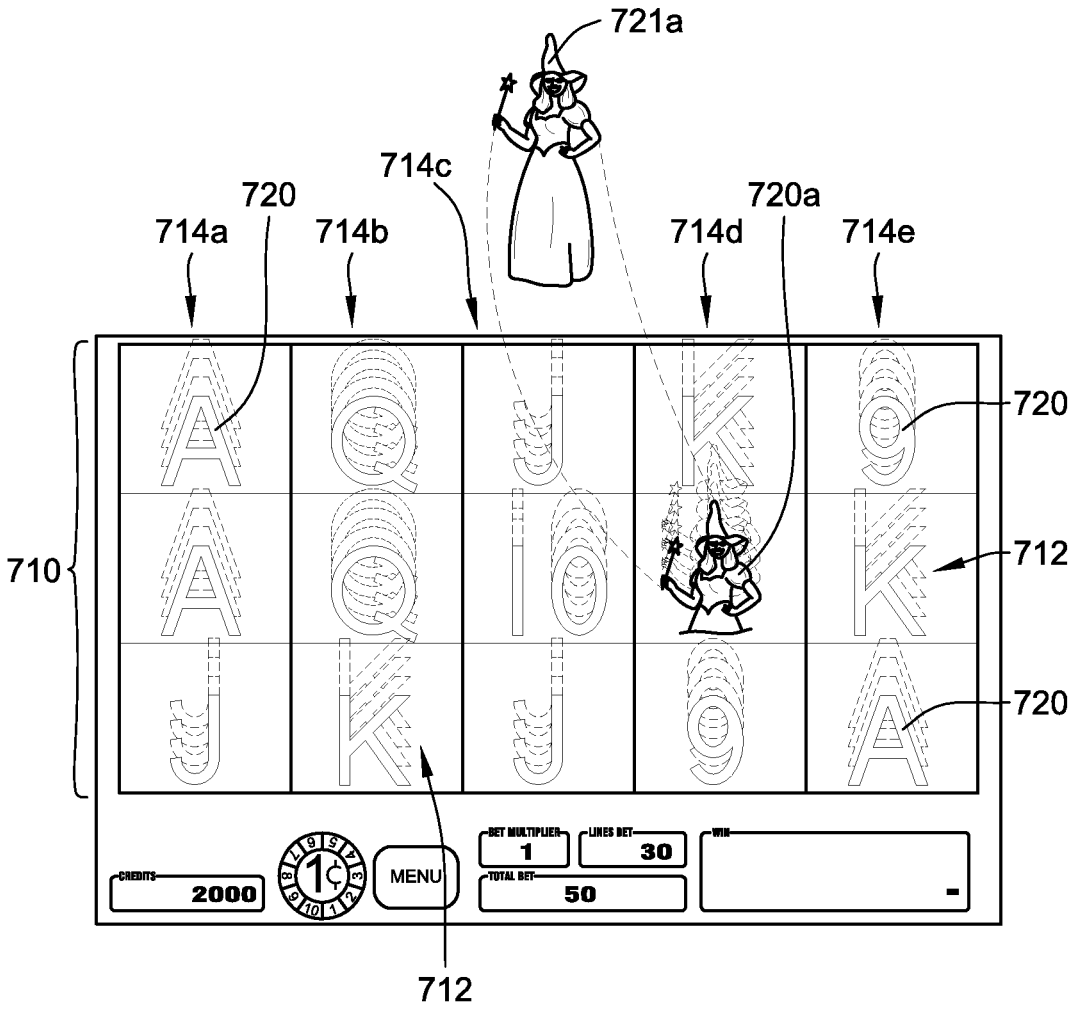
FIGS. 11A-11F are images of exemplary screens of a wagering game including an array-expansion symbol and an array-shrinking symbol for expanding and shrinking an array of symbol positions on a gaming terminal according to some aspects of the present disclosure.

Referring to FIG. 11A, the primary display area 12 and/or the secondary display area 14 displays a base array of symbol positions 710 including five columns 714*a-e* used in conducting a wagering game. The base array of symbol positions 710 is the same as, or similar to, the array of symbol positions 110 described above. In response to receiving a wager to play the wagering game, a plurality of symbols 720 is moved with respect to the base array of symbol positions 710 in the same, or similar, manner as described above in reference to FIGS. 4-5C (i.e., the symbol-bearing reels are spun).

Figure 11B:
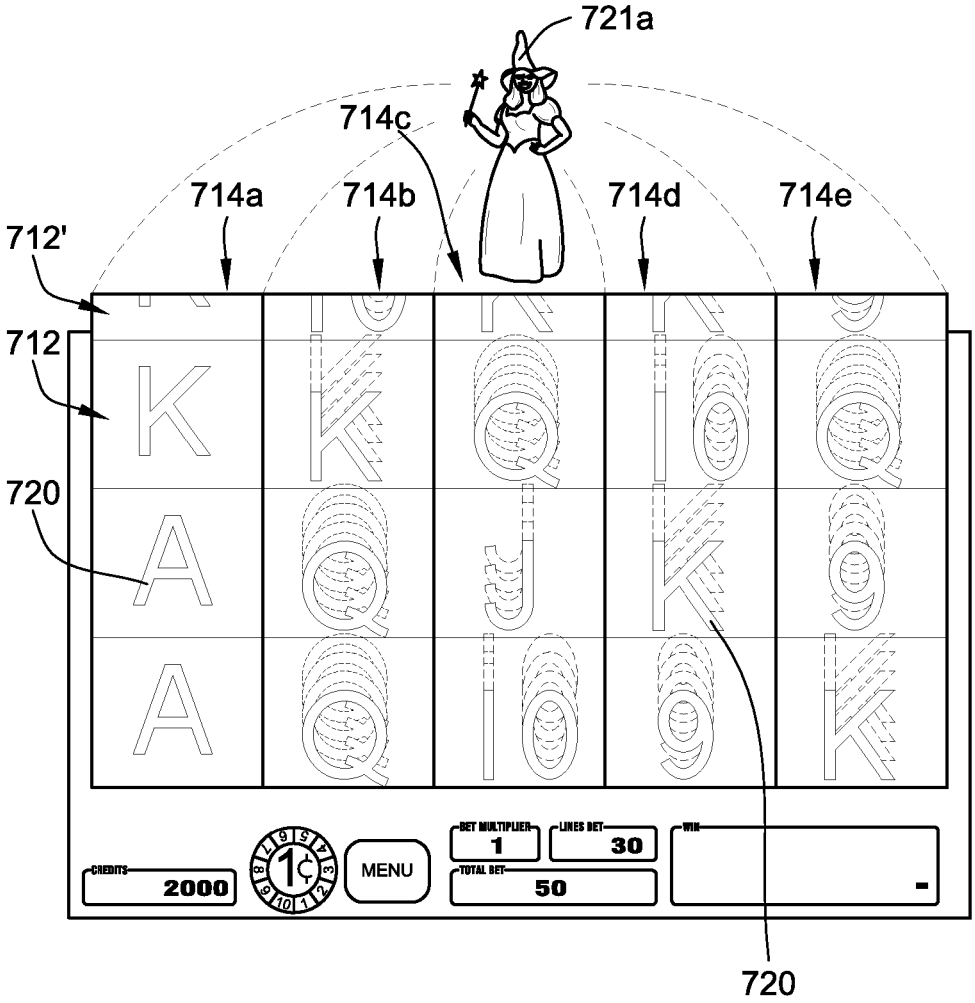
Figure 11C:
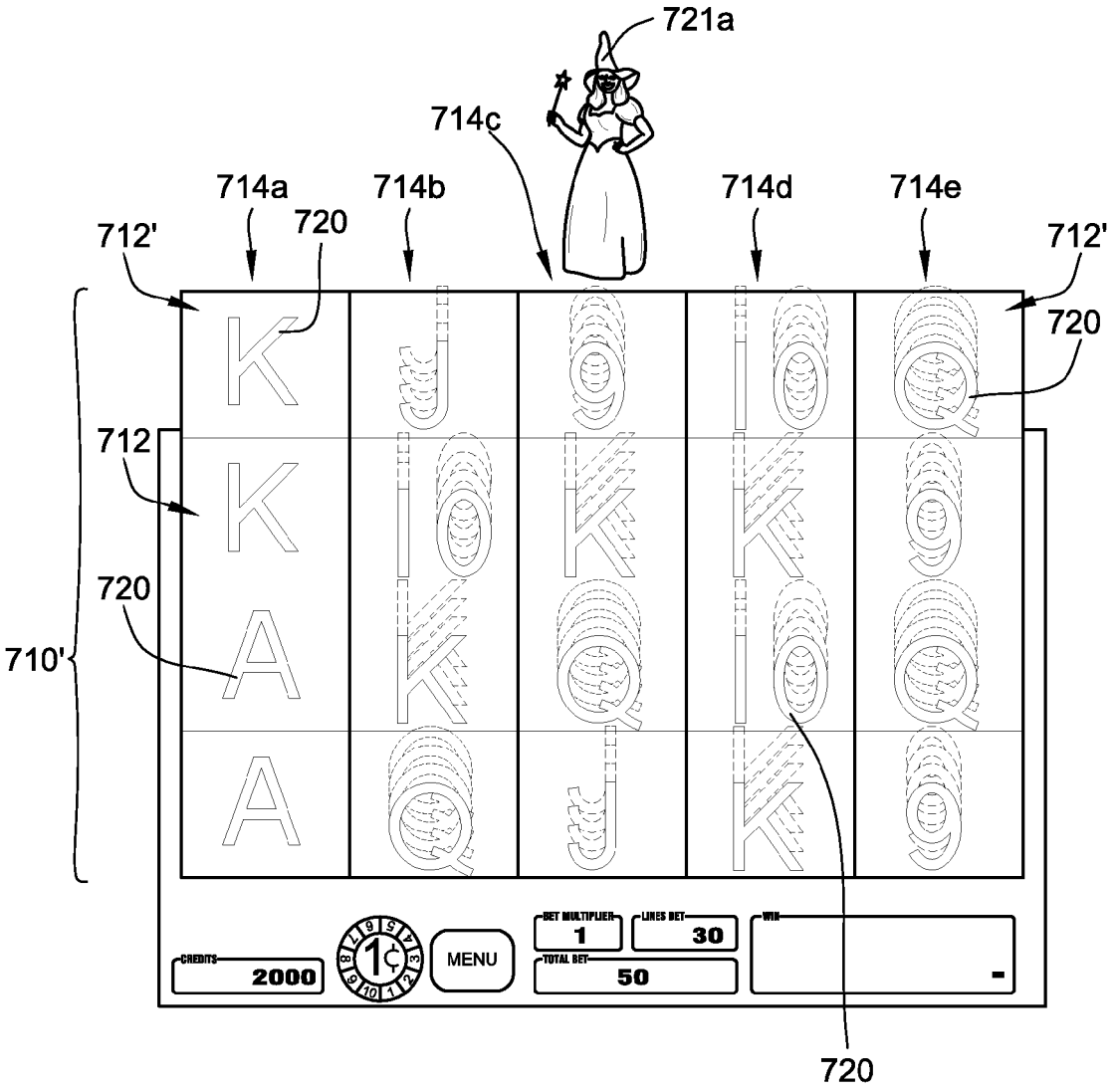
Figure 11D:
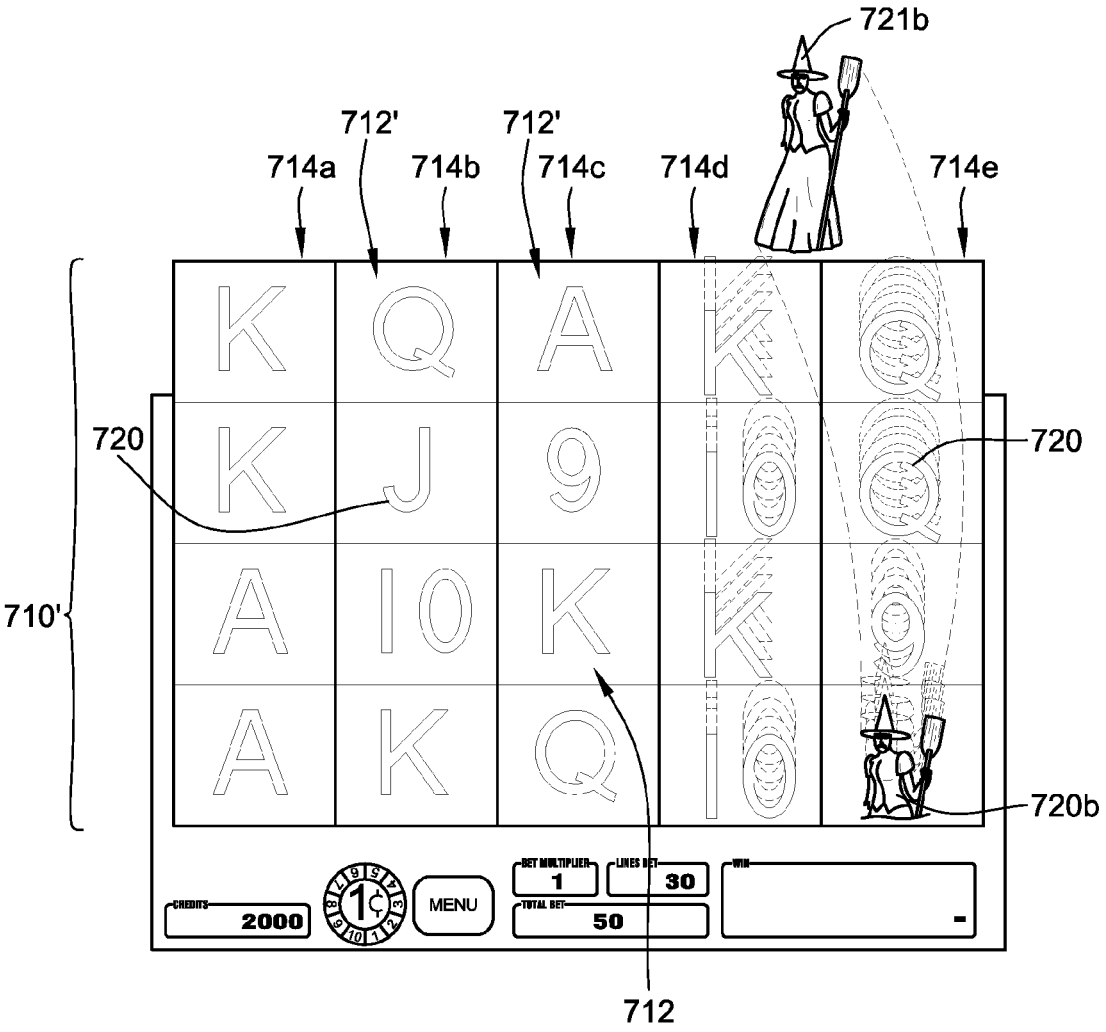
Figure 11E:
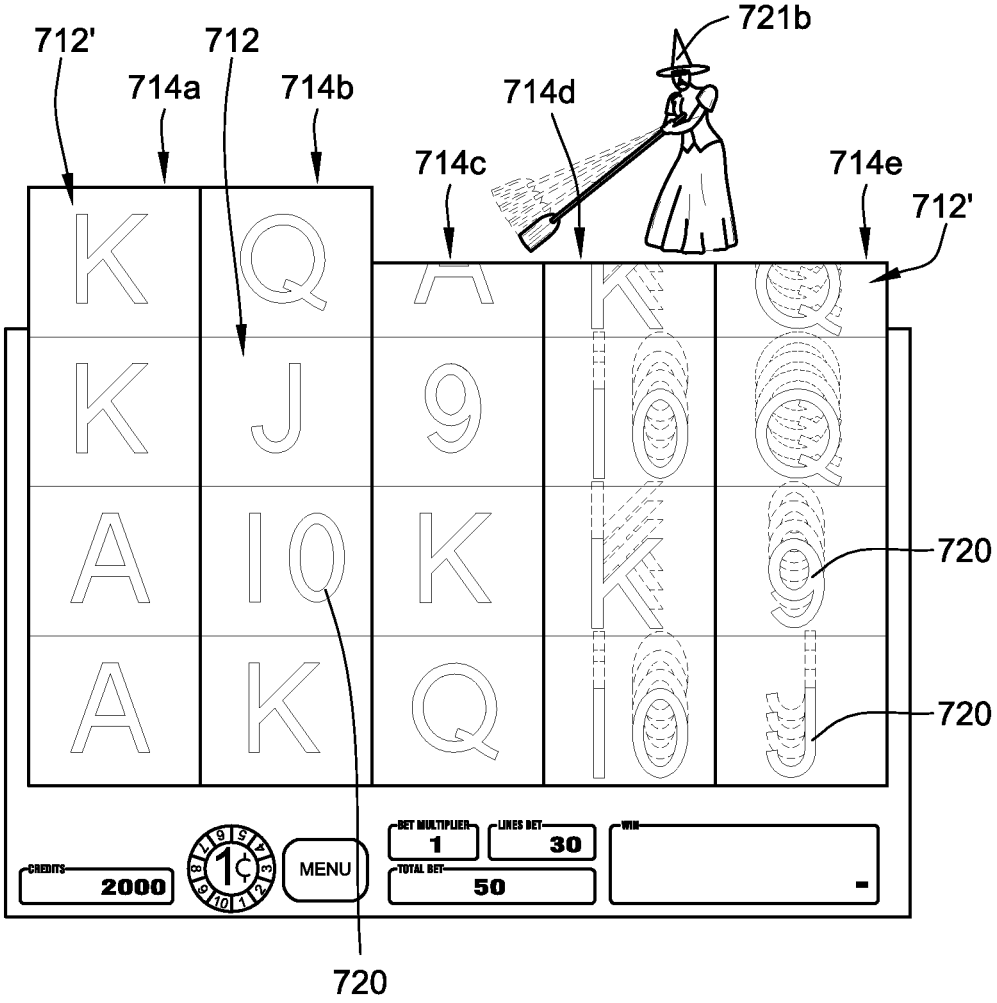
Figure 11F:
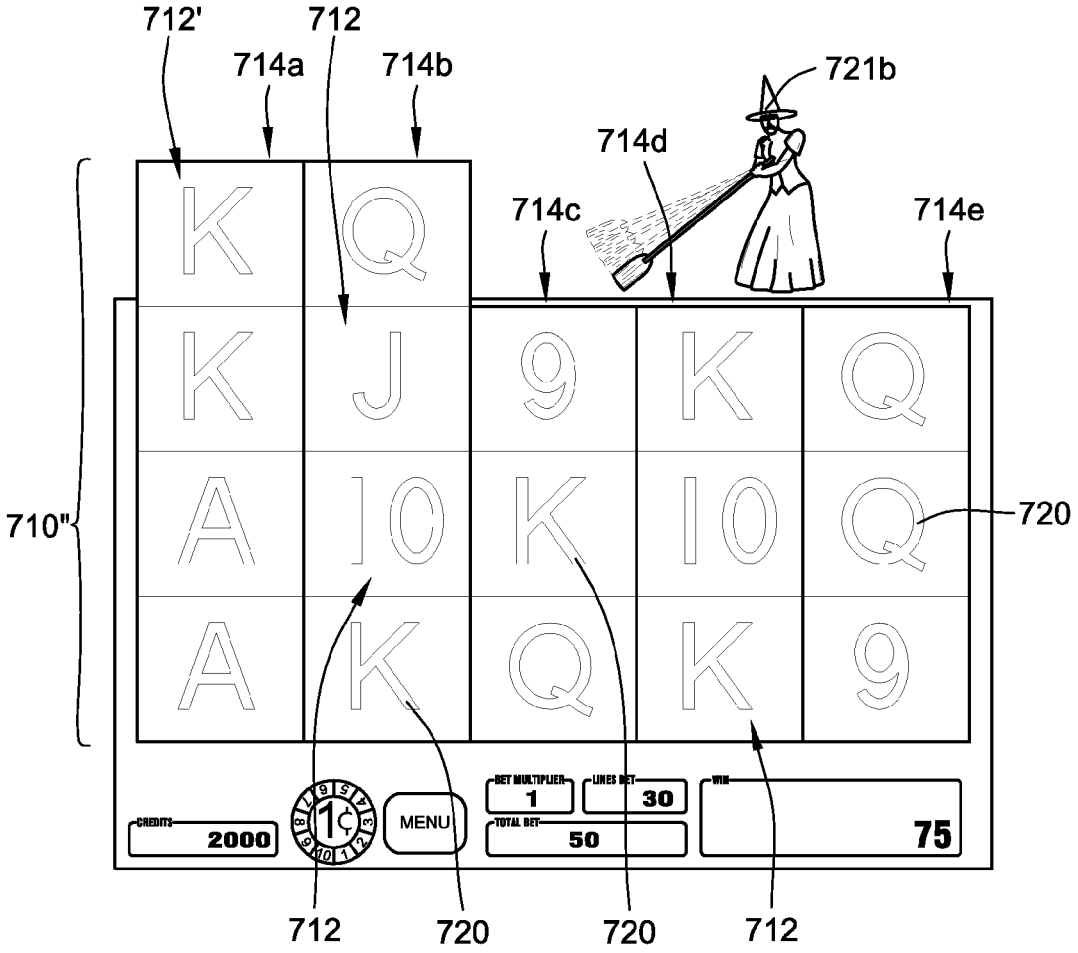

Of the plurality of symbols 720, at least one is an array-expansion symbol 720*a* (FIGS. 11A-11C) and at least one is an array-shrinking symbol 720*b* (FIGS. 11D-11F). As shown in FIG. 11A, the "Good Witch" symbol spinning on the symbol-bearing reel in the fourth column 714*d* of the base array of symbol positions 710 is bolded to illustrate that it is array-expansion symbol 720*a*. The array-expansion symbol 720*a* is used to visually cause the base array of symbol positions 710 (FIG. 11A) to expand into an expanded array of symbol positions 710' (shown in FIG. 11C) while at least one of the symbol-bearing reels remains spinning in the same, or similar, fashion as described above in reference to FIGS. 10A-10D.

Similarly, as shown in FIG. 11D, the "Bad Witch" symbol spinning on the symbol-bearing reel in the fifth column 714*e* of the expanded array of symbol positions 710' is bolded to illustrate that it is an array-shrinking symbol 720*b*. The array-shrinking symbol 720*b* is used to visually cause the expanded array of symbol positions 710' (FIG. 11C) to shrink into a shrunken-expanded array of symbol positions 710" (shown in FIG. 11F) while at least one of the symbol-bearing reels remains spinning (e.g., the reels in the fourth and fifth columns 714*d,e* remain spinning at least during the shrinking, as shown in FIG. 11E).

For example, generally referring to FIGS. 11A-11F, in response to the array-expansion symbol 720*a* appearing in the base array of symbol positions 710 (FIG. 11A) during the spinning of the symbol-bearing reels (i.e., the array-expansion symbol 720*a* is visually moved with respect to the base array of symbol positions 710), the array-expansion symbol 720*a* visually moves or floats off of the symbol-bearing reel in the fourth column 714*d* (FIG. 11A) and is displayed adjacent to (e.g., above, below, side), or at least partially on (not shown), the base array of symbol positions 710 as an array-expansion feature 721*a*. The array expansion feature 721*a* visually causes the base array of symbol positions 710 (FIG. 11A) to expand (partial expansion shown in FIG. 11B) into the expanded array of symbol positions 710' (FIG. 11C) to include at least one additional symbol position 712'. Specifically, as shown, the expanded array of symbol positions 710' includes five additional symbol positions 712', one added to each of the five columns 714*a-e* by the array-expansion feature 721*a*. Various other amounts and locations of additional symbol positions are possible.

Further, in response to the array-shrinking symbol 720*b* appearing in the expanded array of symbol positions 710' (FIG. 11D) during the spinning of the symbol-bearing reels (i.e., the array-shrinking symbol 720*b* is visually moved with respect to the expanded array of symbol positions 710'), the array-shrinking symbol 720*b* visually moves or floats off of the symbol-bearing reel in the fifth column 714*e* (FIG. 11D) and is displayed adjacent to (e.g., above, below, side), or at least partially on (not shown), the expanded array of symbol positions 710' as an array-shrinking feature 721*b*. The array shrinking feature 721*b* visually causes the expanded array of symbol positions 710' (FIG. 11C) to shrink (partial shrinking shown in FIG. 11E) into the shrunken-expanded array of symbol positions 710" (FIG. 11F) such that the shrunken-expanded array of symbol positions 710" includes at least one less symbol position 712 and 712' than the expanded array of symbol positions 710'. Specifically, as shown, the shrunken-expanded array of symbol positions 710" has three less of the additional symbol positions 712' that were previously added, one removed from each of the third, fourth, and fifth columns 714*c-e* by the array-shrinking feature 721*b*.

FIG. 11F illustrates an outcome of the wagering game as all of the symbol-bearing reels have stopped spinning. The outcome includes one of the symbols 720 being associated with each of the symbol positions (712 and 712') in the shrunken-expanded array of symbol positions 710". While the shrunken-expanded array of symbol positions 710" is shown and described as including only two additional symbol position 712' added to the top of the first and the second columns 714*a,b* (and three of the additional symbol positions 712' having been removed/deleted), one or more of the columns 714*a-e* can include one or more additional symbol positions (not shown) in the shrunken-expanded array of symbol positions 710" in the same, or similar, manner as described above. Similarly, while the shrunken-expanded array of symbol positions 710" is shown and described as including the twelve original symbol positions and the two additional symbol position 712', original ones of the symbol positions 712 from one or more of the columns 714*a-e* can be removed/deleted such that less than all of the original symbol positions 712 are included in the shrunken-expanded array of symbol positions (not shown) in the same, or similar, manner that the additional symbol positions 712' were removed from the expanded array of symbol positions 710'.

The adding and removing of symbol positions described above in reference to FIGS. 10A-11F can add excitement and anticipation for players of the wagering game as the adding and removing affects the number of ways for the player to win as described above.

Alternatively to the aspects described above in reference to FIGS. 11A-11F, shrinking of the base array of symbol positions 710 can occur prior to, or without, an accompanied expansion of the base array of symbol positions 710. That is, a final outcome can include symbols associated with less symbol positions than originally included in the base array of symbol positions 710.

Collection of Numerical Symbols for Use in Modifying Awards

Figure 12A:
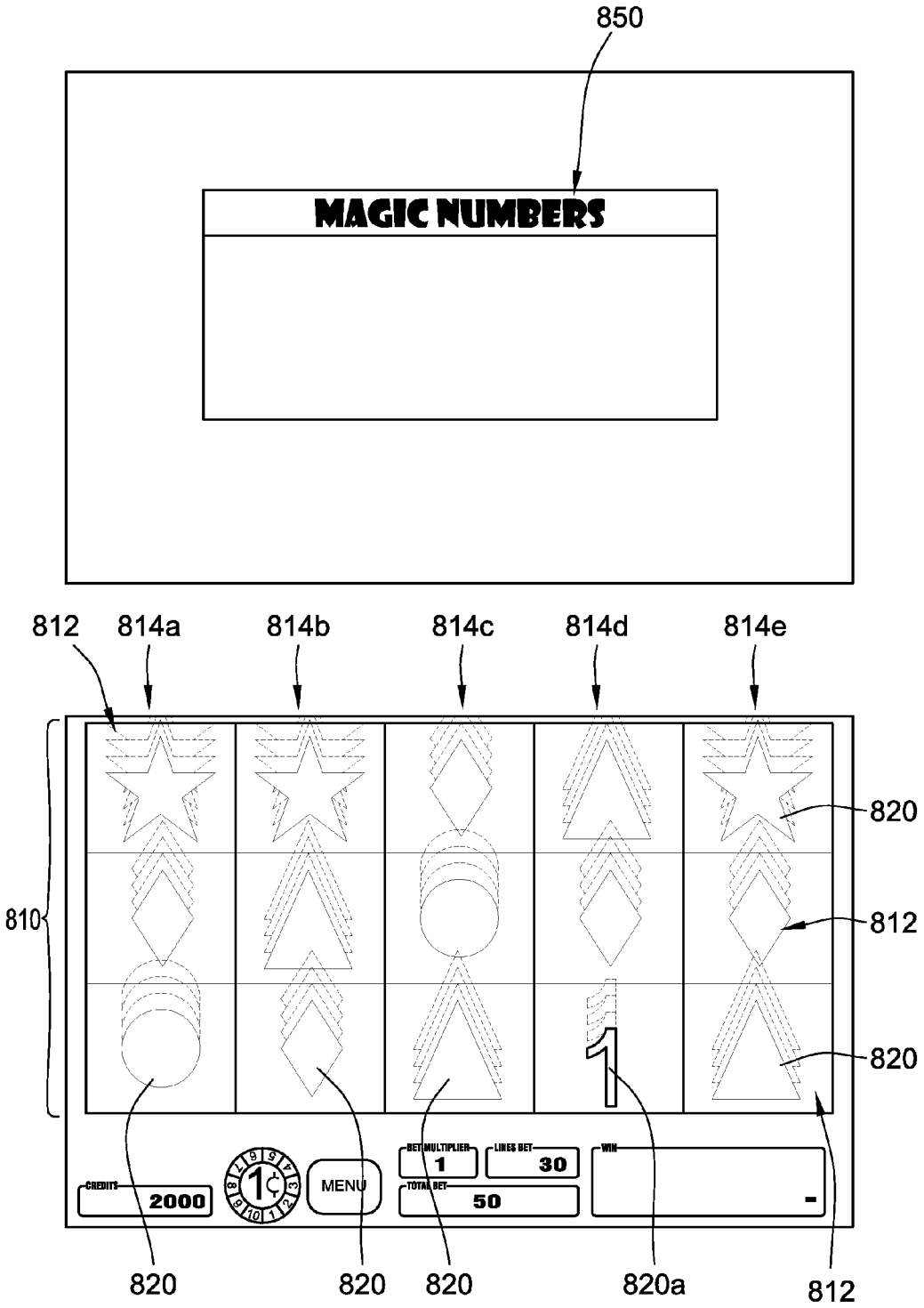
FIGS. 12A-12C are images of exemplary screens of a wagering game including a symbol collection area for collecting numerical symbols on a gaming terminal according to some aspects of the present disclosure.
Figure 12B:
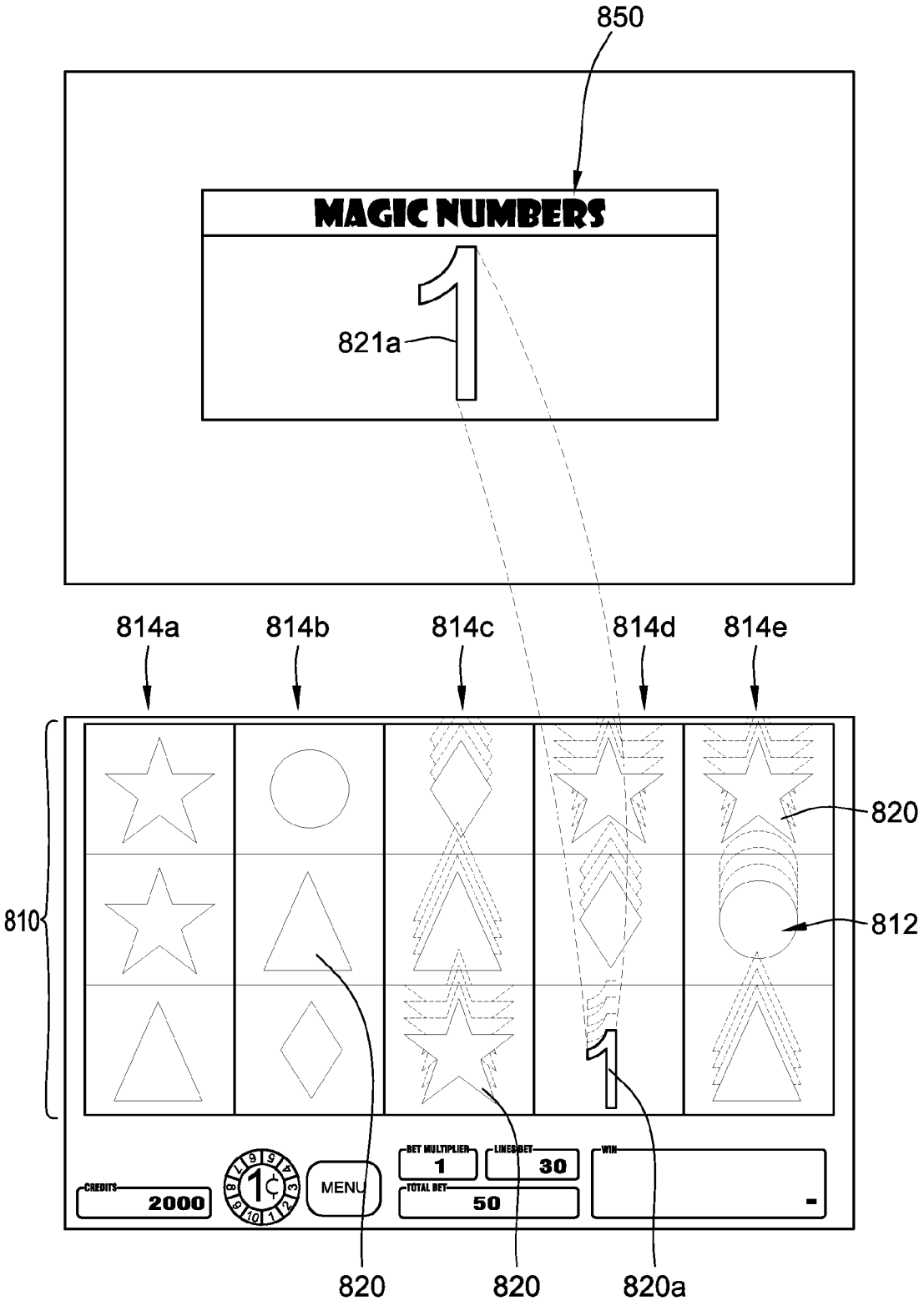
Figure 12C:
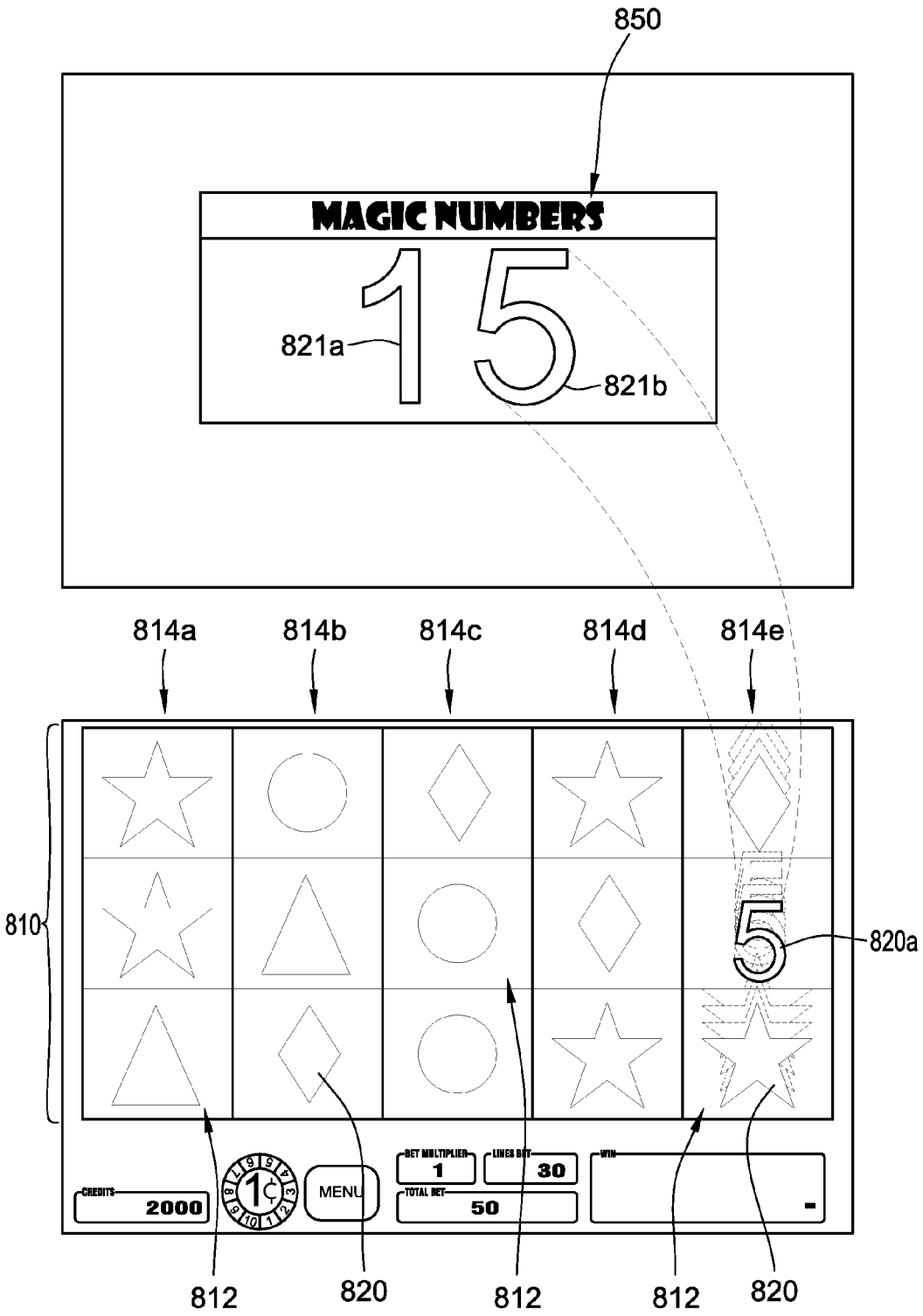

Referring to FIGS. 12A-12C, the primary display area 12 and/or the secondary display area 14 displays an array of symbol positions 810 including five columns 814*a-e* and a symbol collection area 850 used in conducting a wagering game. The array of symbol positions 810 is the same as, or similar to, the array of symbol positions 110 described above. In response to receiving a wager to play the wagering game, a plurality of symbols 820 is moved with respect to the array of symbol positions 810 in the same, or similar, manner as described above in reference to FIGS. 4-5C (i.e., the symbol-bearing reels are spun).

Of the plurality of symbols 820, at least one is a numerical symbol 820*a*. Each numerical symbol 820*a* has an associated numerical value. For example, as shown in FIGS. 12A and 12B, the "1" symbol spinning on the symbol-bearing reel in the fourth column 814*d* of the array of symbol positions 810 is bolded to illustrate that it is a numerical symbol 820*a* having an associated numerical value of one. Similarly, as shown in FIG. 12C, the "5" symbol spinning on the symbol-bearing reel in the fifth column 814*e* of the array of symbol positions 810 is bolded to illustrate that it is also a numerical symbol 820*a* having an associated numerical value of five.

In response one of the numerical symbols 820*a* appearing in the array of symbol positions 810 during the spinning of the symbol-bearing reels (i.e., the numerical symbol is visually moved with respect to the array of symbol positions 810), the numerical symbol 820*a* is visually collected in a symbol collection area 850, in the same, or similar, manner as the symbols are collected in the symbol collection area 150 described above in reference to FIGS. 4-5C. That is, the numerical symbol 820*a* visually moves or floats off of the reel and is displayed in the symbol collection area 850 as collected numerical features 821*a* and 821*b*, as illustrated, respectively, in FIGS. 12B and 12C, while at least one of the reels continues to spin (e.g., the reel in the fifth column 814*e* continues to spin while the "5" symbol is being collected). Further, each time one of the numerical symbols 820*a* spins through the array of symbol positions 810 on one of the symbol-bearing reels, the numerical symbol 820*a* is collected in the symbol collection area 850 as a collected numerical feature. While only two numerical features 821*a* and 821*b* are shown as collected corresponding to the "1" and the "5" numerical symbols, any quantity of numerical symbols can be collected as collected numerical features (e.g., five numerical features can be collected, which correspond to numerical symbols, e.g., 2, 8, 10, 3, and 1) in the symbol collection area 850 (not shown).

Referring to FIG. 12C, the two collected numerical features 821*a* and 821*b* are shown as having been collected in the symbol collection area 850 during the spinning of the reels. Eventually, all of the reels stop spinning and a random outcome (not shown) of the wagering game is displayed such that each of the symbol positions 812 of the array of symbol positions 810 is associated with one of the symbols 820. The outcome is evaluated to determine if it is a winning outcome. If the outcome is a winning outcome, an award is achieved by the player of the wagering game (e.g., 20 credits), where the award is based at least partially on the winning outcome. The award can also be displayed to the player on the primary and or secondary display areas 12, 14, such as, for example, in a popup window and/or in an award/win credit meter like the game-session credit meter 54 described above in reference to FIG. 3.

Additionally, after or prior to displaying the award to the player, the award can be modified based on the numerical values associated with one or more of the collected numerical features 821*a* and 821*b*. For example, the numerical values of the collected numerical features 821*a* and 821*b* can be summed together to determine a value (e.g., 1+5=6 credits) and the determined value can be added to the award to calculate an enhanced award (e.g., 20+6=26 credits). For another example, the numerical values of the collected numerical features 821*a* and 821*b* can be summed together to determine a value (e.g., 1+5=6× multiplier) and the determined value can be multiplied by the award as a multiplier to calculate an enhanced award (e.g., 6×20 credits=120 credits). For another example, the numerical values of the collected numerical features 821*a* and 821*b* can be read in the order collected to determine a value (e.g., 15) and the determined value can either be added to the award to calculate an enhanced award (e.g., 15 credits+20 credits=35 credits) or the value can be multiplied by the award as a multiplier to calculate an enhanced award (e.g., 15×20 credits=300 credits). For yet another example, the numerical values of the collected numerical features 821*a* and 821*b* can be rearranged and/or read in a random order to determine a value (e.g., 1 and 5 can be rearranged and/or randomized to arrive at a determined value 51) and the determined value can either added to the award to calculate an enhanced award (e.g., 51 credits+20 credits=71 credits) or the determined value can be multiplied by the award as a multiplier to calculate an enhanced award (e.g., 51×20 credits=1020 credits).

The collected numerical features 821*a* and 821*b* can remain in the symbol collection area 850 for two or more plays of the wagering game prior to modifying an award. Thus, in the case that an outcome of the wagering game is not a winning outcome, the collected numerical features 821*a* and 821*b* can remain in the symbol collected area 850 for use in a subsequent play of the wagering game that ends in a winning outcome being displayed. Alternatively, in the case of a non-winning outcome being displayed, one or more of the collected numerical features can be automatically removed from the symbol collection area 850 without being used to modify a winning outcome in the future.

In some alternatives of the present concepts, the symbol collection area 850 can only store a predetermined number of collected numerical features (e.g., 3, 5, 10, etc.). In some such alternatives, when the capacity of the symbol collection area 850 is reached (e.g., the capacity is three and three numerical features were previously collected and are currently stored in the symbol collection area 850), any additional numerical features to be collected can either (1) cause a previously collected numerical feature to be removed from the symbol collection area 850 to make room or (2) not be collected and be visually discarded (not shown).

The numerical features 821*a* and 821*b* can also be referred to as magic or magical numbers as each numerical feature has a numerical value that can be used in a variety of ways to modify an award as described above. That is, each of the collected numerical features can be applied to an award in different functions (e.g., multiply, add, subtract, etc.). In some such alternatives, the manner that a collected numerical feature is applied to an award can be determined: (1) randomly, (2) by a player input, (3) based on an amount of the player's wager, (4) based on one or more trigger symbols spinning through the array of symbol positions during the play of the wagering game, and/or (5) based on one or more symbols being present in an outcome of the wagering game.

Multi-Array with Symbol Transfer Between Arrays During Spinning of Reels

Figure 13A:
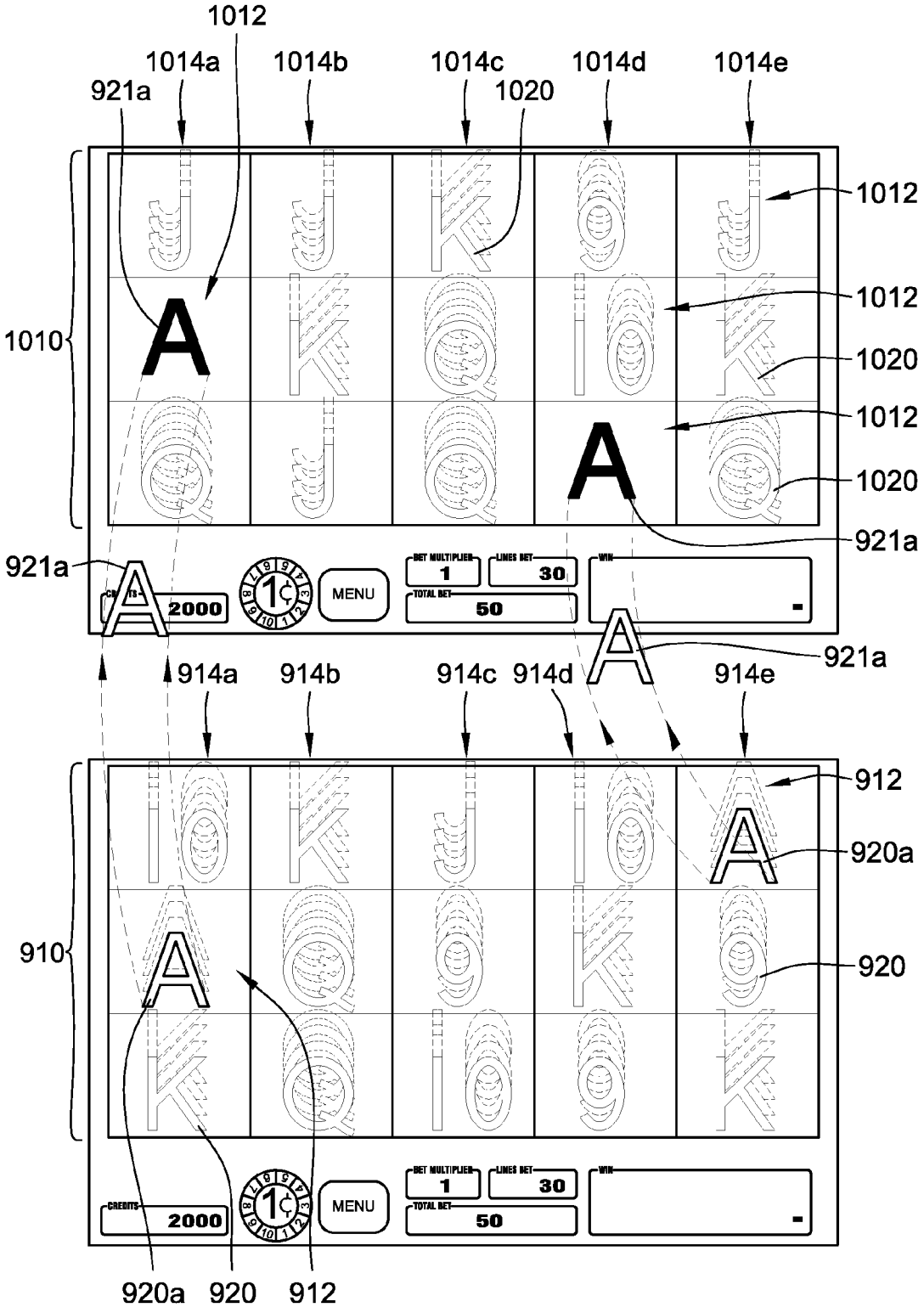
FIGS. 13A-13C are images of exemplary screens of a wagering game including two arrays of symbol positions for transferring symbols from the first array to the second array on a gaming terminal according to some aspects of the present disclosure.
Figure 13B:
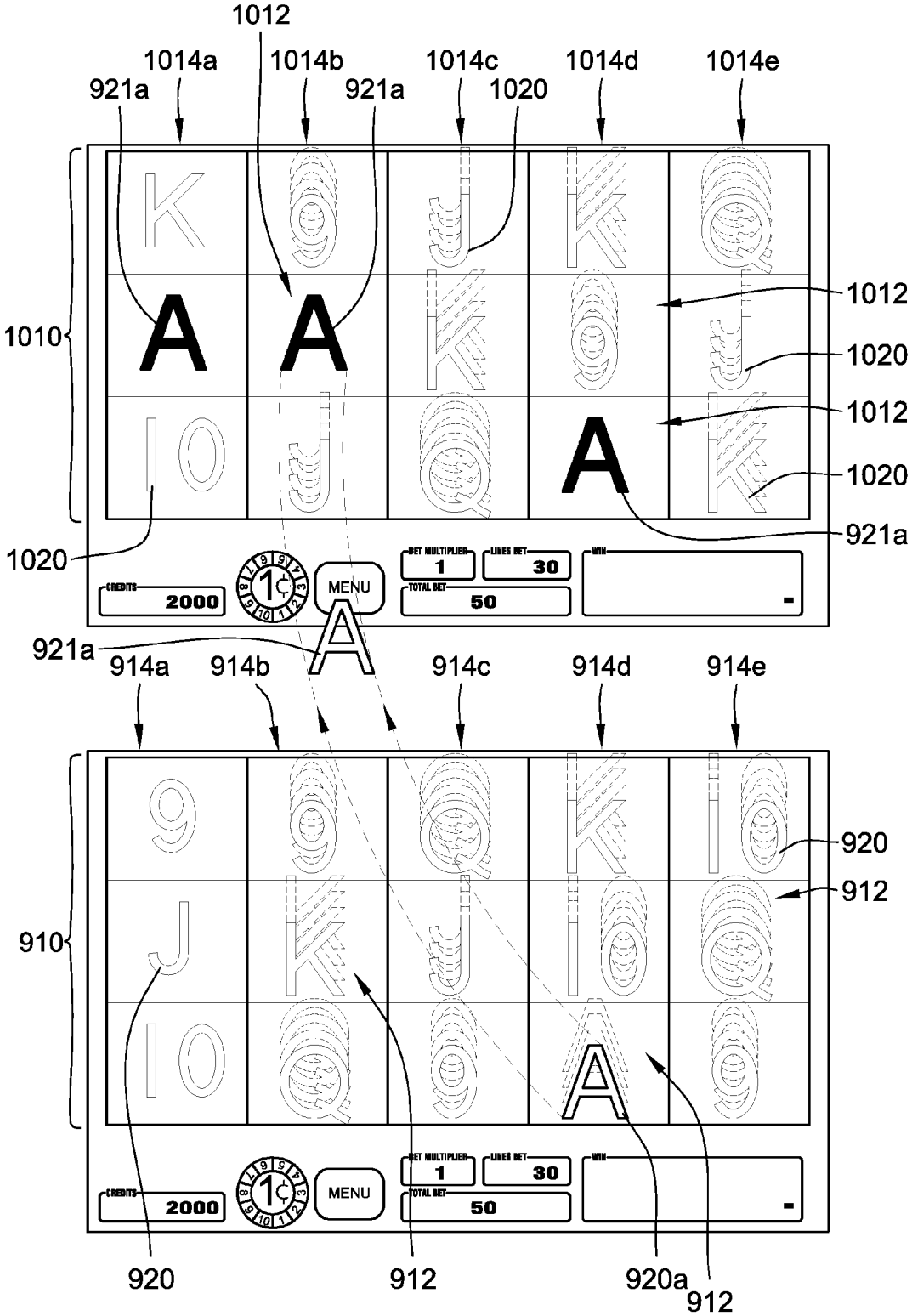
Figure 13C:
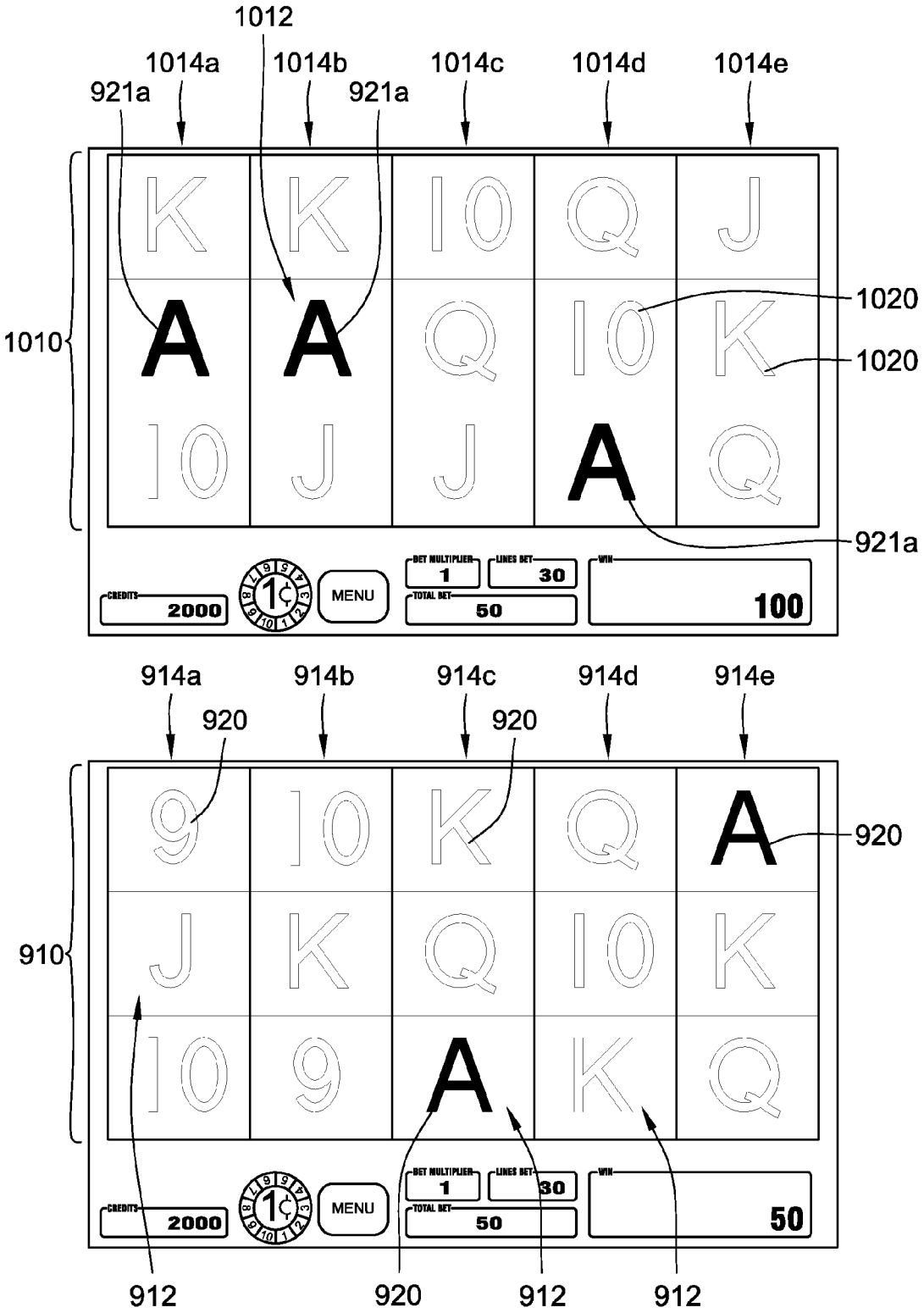

Referring to FIGS. 13A-13C, the primary display area 12 and/or the secondary display area 14 displays a first array of symbol positions 910 including five columns 914*a*-*e* and a second array of symbol positions 1010 including five columns 1014*a*-*e* used in conducting a wagering game. The first array of symbol positions 910 and the second array of symbol positions 1010 are the same as, or similar to, the array of symbol positions 110 described above. In response to receiving a wager to play the wagering game, a first plurality of symbols 920 is moved with respect to the first array of symbol positions 910 and a second plurality of symbols 1020 is moved with respect to the second array of symbol positions 1010 in the same, or similar, manner as described above in reference to FIGS. 4-5C (i.e., the symbol-bearing reels are spun). Alternatively, the second plurality of symbols 1020 is moved only in response to receiving a second wager to play the wagering game in addition to a wager received to cause the first plurality of symbols 920 to move.

Of the first plurality of symbols 920, at least one is a selected or special symbol 920*a*, which is the same as, or similar to, the selected symbol 120*a* described above in reference to FIGS. 4-5C. In response one of the selected symbols 920*a* appearing in one of the symbol positions 912 in the first array of symbol positions 910 during the spinning of the symbol-bearing reels (i.e., the selected symbol is visually moved with respect to the first array of symbol positions 910), the selected symbol 920*a* is visually transferred to the second array of symbol positions 1010. The visually transferred selected symbol 920*a* is visually transferred such that it is associated with one of the symbol positions 1012 of the second array of symbol positions 1010. That is, the selected symbol 920*a* visually moves or floats off of the reel in the first array of symbol positions 910 and is displayed in the second array of symbol positions 1010 as a transferred symbol 921*a*, while at least one of the reels of the first array of symbol positions 910 and/or the second array of symbol positions 1010 continues to spin.

For example, as illustrated in FIG. 13A, a first one of the selected symbols 920*a* in the first column 914*a* of the first array of symbol positions 910 is visually transferred to a symbol position 1012 in the first column 1014*a* of the second array of symbol positions 1010 and a second one of the selected symbols 920*a* in the fifth column 914*e* of the first array of symbol positions 910 is visually transferred to a symbol position 1012 in the fourth column 1014*d* of the second array of symbol positions 1010. Similarly, as illustrated in FIG. 13B, a third one of the selected symbols 920*a* in the fourth column 914*d* of the first array of symbol positions 910 is visually transferred to a symbol position 1012 in the second column 1014*b* of the second array of symbol positions 1010. The location of the symbol positions 912 from which the selected symbols 920*a* are removed from the first array of symbol positions 910 can be random. Similarly, the location of the symbol positions 1012 to which the transferred symbols 921*a* are associated with can be random, based on one or more predetermined patterns, or based at least in part on a player input.

Each time one of the selected symbols 920*a* spins through the first array of symbol position 910 on one of the symbol-bearing reels, the selected symbol 920*a* is visually transferred to the second array of symbol positions 1010 as a transferred symbol 921*a*. Alternatively, the selected symbols 920*a* are only transferred to the second array of symbol positions 1010 after a trigger, such as, for example, a random or mystery trigger or a trigger symbol being spun through the first and/or the second array of symbol positions 910, 1010. While only three transferred symbols 921*a* are shown as being transferred to the second array of symbol positions 1010 (see FIG. 13C), any quantity of transferred symbols 921*a* can be visually transferred (e.g., 1, 2, 3, 5, 10, etc.) to the second array of symbol positions 1010 (not shown).

Referring to FIG. 13B, the three transferred symbols 921*a* are shown as having been transferred to the second array of symbol positions 1010 during the spinning of the reels. Eventually, all of the reels in the first array of symbol positions 910 stop spinning and a first random outcome (FIG. 13C) of the wagering game is displayed such that each of the symbol positions 912 is associated with one of the symbols 920. Similarly, all of the reels in the second array of symbol positions 1010 stop spinning and a second random outcome (FIG. 13C) of the wagering game is displayed and such that each of the symbol positions 1012 is associated with one of the symbols 1020 or with one of the transferred symbols 921*a*. Specifically, the second outcome includes the three transferred symbols 921*a* that were visually transferred during the spinning of at least one of the reels.

Both outcomes can be evaluated to determine if either is one is a winning outcome. If either outcome is a winning outcome, an award is achieved by the player of the wagering game (e.g., 50 or 100 credits), where the award is based at least partially on the respective winning outcome. The award can also be displayed to the player on the primary and or secondary display areas 12, 14, such as, for example, in a popup window and/or in an award/win credit meter like the game-session credit meter 54 described above in reference to FIG. 3.

The transferred symbols 921*a* can be high paying symbols, wild symbols, scatter pay symbols, bonus triggering symbols, any other known type of symbols, or any combination thereof. Thus, the transferring of the transferred symbols 921*a* can increase a player's anticipation and excitement when playing the wagering game. For example, in the case of the transferred symbols 921*a* being high paying symbols or wild symbols, the transfer of the transferred symbols 921*a* to the second array of symbol positions 1010 can positively affect the outcome of the wagering game by associating the transferred symbols 921*a* with symbol positions 1012 that cause a relatively higher paying award to be achieved as compared with the award that the player would have achieved without the transferred symbols 921*a* being so transferred.

Snapshot/Picture of Spinning Symbols to Collect Special Symbols Captured in Picture The primary display area 12 and/or the secondary display area 14 displays an array of symbol positions including five columns and a symbol collection area (e.g., symbol collection area 150) used in conducting a wagering game. The array of symbol positions is the same as, or similar to, the array of symbol positions 110 described above. In response to receiving a wager to play the wagering game, a plurality of symbols is moved with respect to the array of symbol positions in the same, or similar, manner as described above in reference to FIGS. 4-5C (i.e., the symbol-bearing reels are spun).

Of the plurality of symbols, at least one is a special symbol. The special symbols can be wild symbols, multipliers, bonus triggers, scatter pay triggers, progressive pay triggers, high pay symbols, or a combination thereof. During the visually moving/spinning of the symbols, a player of the wagering game uses an input device (e.g., touch screen, button, etc.) to instantaneously freeze the array of symbol positions being spun on the array of symbol positions at that moment. That is, the player takes an electronic picture of the array of symbol positions and the symbols associated with each of the symbol positions at that instant. The electronic picture depicts an instantaneous outcome of the wagering game that is based on the player's input.

That instantaneous outcome can be evaluated to determine (1) if it is a winning outcome and/or (2) to determine is the outcome includes any of the special symbols. If it is determined that the instantaneous outcome includes one or more of the special symbols, the special symbols can be collected in the symbol collection area in the same, or similar, manner as described herein in reference to the symbol collection areas 150 and/or 850. Additionally, an award achieved based on the instantaneous outcome can be modified based on the collected ones of the special symbols in the same, or similar, manner as described herein.

While the instantaneous outcome is described as being an exact picture of the symbols being displayed when the player input is received, the actual instantaneous outcome evaluated can be randomly determined such that the player merely perceives that the player has control over the instantaneous outcome when in reality the instantaneous outcome is randomly determined/selected.

Spinning Symbol Scatterer/Redirection Feature

The primary display area 12 and/or the secondary display area 14 displays an array of symbol positions including five columns used in conducting a wagering game. The array of symbol positions is the same as, or similar to, the array of symbol positions 110 described above. In response to receiving a wager to play the wagering game, a plurality of symbols is moved with respect to the array of symbol positions in the same, or similar, manner as described above in reference to FIGS. 4-5C (i.e., the symbol-bearing reels are spun).

Of the plurality of symbols, at least one is a trigger symbol and at least one is a bonus or special symbol. The bonus or special symbols can be wild symbols, multipliers, bonus triggers, scatter pay triggers, progressive pay triggers, high pay symbols, or a combination thereof. If one or more of the trigger symbols is spun through the array of symbol positions and displayed during the rotation of the reels, a symbol scatterer/redirection feature can be activated. The symbol scatterer/redirection feature visually causes any of the bonus symbols associated with predetermined ones of the reels to be visually transferred from those reels to at least one of the other reels. Specifically, the bonus symbols are visually transferred from, for example, a first one of the reels to, for example, a second one of the reels such that each of the visually transferred bonus symbols is associated with a symbol position in the column being occupied by the other reel.

After one or more of the bonus symbols are transferred, a randomly selected outcome for the array of symbol positions can be displayed that includes at least a portion of the plurality of symbols and the visually transferred bonus symbols such that each of the visually transferred bonus symbols remains associated with the respective symbol positions during evaluation of the outcome. The randomly selected outcome can then be evaluated to determine if the random outcome, including the visually transferred bonus symbols, is a winning outcome. As the transferred bonus symbols can be, for example, high pay symbols or wild symbols, etc., the transferred bonus symbols can positively affect the outcome of the wagering game by transferring and associating the bonus symbols with symbol positions that cause a relatively higher paying award to be achieved as compared with the award that the player would have achieved without the bonus symbols being so transferred.

Bingo/Keno Game Populated with Spinning Symbols from Reels

The primary display area 12 and/or the secondary display area 14 displays an array of symbol positions including five columns and a game board used in conducting a wagering game. The array of symbol positions is the same as, or similar to, the array of symbol positions 110 described above. In response to receiving a wager to play the wagering game, a plurality of symbols is moved with respect to the array of symbol positions in the same, or similar, manner as described above in reference to FIGS. 4-5C (i.e., the symbol-bearing reels are spun).

Of the plurality of symbols, at least one is an alphanumeric symbol associated with a number or a letter. In response to the alphanumeric symbol being displayed during the visual rotation of at least one of the symbol-bearing reels, the alphanumeric symbol visually moves or floats off of the reel and is visually moved towards the game board as a moving alphanumeric symbol. The moving alphanumeric symbol can interact with the game board based on the value (i.e., number or letter) associated with the moving alphanumeric symbol and based on the content of the game board. For example, in the case of the game board being a bingo game board or a keno game board, if the value of the moving alphanumeric symbol is found on the game board, the moving alphanumeric symbol can populate the corresponding position of the game board. After each time a moving alphanumeric symbol populate the game board, the game board can be evaluated to determine if the visually moved alphanumeric symbols populated on the game board comprise a winning outcome.

Alternative Concepts Sections

The following sections include several alternatives to the above described concepts. Any of the following alternatives can be combined with one or more portions of the above disclosure and/or one or more portions of any other alternative described below.

Activation Symbol Required Prior to Collection of Trigger Symbols

A method for conducting a wagering game via a gaming terminal includes receiving, via an input device, a wager to play the wagering game; displaying, on one or more display devices, a plurality of symbol-bearing reels, the symbol-bearing reels including a plurality of symbols, at least one of the symbols being an activator symbol and at least one of the symbols being a trigger symbol; causing the symbol-bearing reels to visually rotate such that at least a portion of the symbols are displayed on the one or more display devices during the rotation; and in response to the activator symbol being displayed on the one or more display devices during the visual rotation of at least one of the symbol-bearing reels, collecting each trigger symbol displayed on the one or more display devices during the rotation of the symbol-bearing reels. The collecting can include causing the trigger symbol to visually move from the rotating symbol-bearing reel to a collection area. The method can further comprise in response to a predetermined number of trigger symbols being collected, triggering a game feature.

Trigger Symbols Cause Bonus Game with Number of Plays Based on Trigger Symbols

A method for conducting a wagering game via a gaming terminal includes receiving, via an input device, a wager to play the wagering game; displaying, on one or more display devices, an array of symbol positions arranged in a plurality of columns; moving a plurality of symbols with respect to the array of symbol positions on the one or more display devices, a plurality of the symbols being trigger symbols; in response to a predetermined number of trigger symbols being moved with respect to the array of symbol positions, triggering a bonus game; and in response to the triggering, displaying a bonus game, the bonus game including a number of free plays, the number of free plays equaling the number of trigger symbols that are moved with respect to the plurality of symbol positions during the moving prior to the triggering.

Trigger Symbols Cause Multiplier Feature

A method for conducting a wagering game via a gaming terminal includes receiving, via an input device, a wager to play the wagering game; displaying, on one or more display devices, an array of symbol positions arranged in a plurality of columns; moving a plurality of symbols with respect to the array of symbol positions on the one or more display devices, a plurality of the symbols being trigger symbols; in response to a predetermined number of trigger symbols being moved with respect to the array of symbol positions, triggering a multiplier feature; in response to the triggering, awarding a player of the wagering game a multiplier; displaying a randomly selected outcome of the wagering game on the one or more display devices; evaluating the randomly selected outcome to determine if the outcome is a winning outcome; and in response to determining that the outcome is a winning outcome, multiplying an award associated with the winning outcome by the awarded multiplier.

Trigger Symbols Cause Scatter Pay Feature

A method for conducting a wagering game via a gaming terminal includes receiving, via an input device, a wager to play the wagering game; displaying, on one or more display devices, an array of symbol positions arranged in a plurality of columns; moving a plurality of symbols with respect to the array of symbol positions on the one or more display devices, a plurality of the symbols being trigger symbols; in response to a predetermined number of trigger symbols being moved with respect to the array of symbol positions, triggering a scatter pay feature; displaying a randomly selected outcome of the wagering game on the one or more display devices; and evaluating the randomly selected outcome to determine if the outcome is a winning outcome according to a scatter pay rule.

Trigger Symbols Cause Transforming Triggers into Wilds

A method for conducting a wagering game via a gaming terminal including receiving, via an input device, a wager to play the wagering game; displaying, on one or more display devices, an array of symbol positions arranged in a plurality of columns; moving a plurality of symbols with respect to the array of symbol positions on the one or more display devices, a plurality of the symbols being trigger symbols; in response to a predetermined number of trigger symbols being moved with respect to the array of symbol positions, triggering a wild symbol feature; and in response to the triggering, transforming all of the trigger symbols into wild symbols while at least a portion of the symbols are moving with respect to the array of symbol positions.

Trigger Symbols Cause Wild Column Feature

A method for conducting a wagering game via a gaming terminal including receiving, via an input device, a wager to play the wagering game; displaying, on one or more display devices, an array of symbol positions arranged in a plurality of columns; moving a plurality of symbols with respect to the array of symbol positions on the one or more display devices, a plurality of the symbols being trigger symbols; in response to a predetermined number of trigger symbols being moved with respect to the array of symbol positions, triggering a wild reel feature; and in response to the triggering, converting one of the columns into an all wild column such that each symbol position of the all wild column is associated with a wild symbol.

Multi-Array with Symbol Transfer During Reel Spinning

A method for conducting a wagering game via a gaming terminal includes receiving, via an input device, a wager to play the wagering game; displaying, on one or more display devices, a first array of symbol positions arranged in a plurality of columns; visually moving at least a portion of a first plurality of symbols with respect to the first array of symbol positions on the one or more display devices, one or more of the first plurality of the symbols being special symbols; and in response to one or more of the special symbols being visually moved with respect to the first array of symbol positions on the one or more display devices, causing the visually moved special symbols to be visually transferred to a second array of symbol positions on the one or more display devices such that each of the visually transferred special symbols is associated with one of the symbol positions of the second array of symbol positions.

The method can further include visually moving at least a portion of a second plurality of symbols with respect to the second array of symbol positions on the one or more display devices.

The method can further include displaying a first randomly selected outcome for the first array of symbol positions on the one or more display devices, the first randomly selected outcome including at least a portion of the first plurality of symbols; and evaluating the first randomly selected outcome to determine if the first outcome is a winning outcome.

The method can further include displaying a second randomly selected outcome for the second array of symbol positions on the one or more display devices, the second randomly selected outcome including at least a portion of the second plurality of symbols and the visually transferred special symbols; and evaluating the second randomly selected outcome to determine if the second outcome is a winning outcome.

Collection of Numbers for Use in Modifying Awards

A method for conducting a wagering game via a gaming terminal includes receiving, via an input device, a wager to play the wagering game; displaying, on one or more display devices, an array of symbol positions arranged in a plurality of columns; visually moving at least a portion of a plurality of symbols with respect to the array of symbol positions on the one or more display devices, the plurality of the symbols including a plurality of numerical symbols, each numerical symbol having an associated numerical value; in response to one or more of the numerical symbols being visually moved on the one or more display devices, causing the visually moved numerical symbols to be visually collected in a symbol collection area adjacent to the array of symbol positions on the one or more display devices; displaying, on the one or more display devices, a randomly selected outcome of the wagering game such that each of the symbol positions is associated with a single one of the plurality of symbols; evaluating the randomly selected outcome to determine if the outcome is a winning outcome; in response to determining that the outcome is a winning outcome, awarding a player of the wagering game with an award; and in response to the visually collection of one or more numerical symbols, modifying the award based on the numerical value associated with each one of the visually collected numerical symbols.

Picture of Spinning Symbols to Collect Special Symbols Captured in Picture

A method for conducting a wagering game via a gaming terminal includes receiving, via one or more input devices, a wager to play the wagering game; displaying, on one or more display devices, an array of symbol positions arranged in a plurality of columns; visually moving at least a portion of a plurality of symbols with respect to the array of symbol positions on the one or more display devices, one or more of the plurality of the symbols being special symbols; during the visually moving, receiving, via the one or more input devices, a first freeze array instruction; and in response to the receiving the first freeze array instruction, instantaneously evaluating a first randomly selected outcome of the wagering game displayed on the one or more display devices.

The method wherein the instantaneously evaluating can further include determining whether the first randomly selected outcome includes any of the special symbols; and in response to the determining that the first randomly selected outcome includes one or more of the special symbols, collecting the one or more of the special symbols.

The method wherein the special symbols are wild symbols, multipliers, bonus triggers, scatter pay triggers, progressive pay triggers, high pay symbols, or a combination thereof.

The method can further include modifying a game outcome or game play based on the collected one or more of the special symbols.

Multiple Pictures of Spinning Symbols and Evaluation of Pictures at End

A method for conducting a wagering game via a gaming terminal including receiving, via one or more input devices, a wager to play the wagering game; displaying, on one or more display devices, an array of symbol positions arranged in a plurality of columns; visually moving at least a portion of a plurality of symbols with respect to the array of symbol positions on the one or more display devices, one or more of the plurality of the symbols being special symbols; during the visually moving, receiving, via the one or more input devices, a plurality of freeze array instructions; and in response to the receiving each of the plurality of freeze array instructions, instantaneously storing a corresponding randomly selected outcome of the wagering game displayed on the one or more display devices.

The method can further include evaluating each of the stored randomly selected outcomes of the wagering game.

Spinning Symbol Scatterer/Redirection Feature

A method for conducting a wagering game via a gaming terminal including receiving, via an input device, a wager to play the wagering game; displaying, on one or more display devices, an array of symbol positions formed by a plurality of symbol-bearing reels, the array of symbol positions being arranged in a plurality of columns such that each of the columns is occupied by one of the symbol-bearing reels; causing the symbol-bearing reels to visually rotate such that at least a portion of a plurality of symbols are displayed on the one or more display devices during the visual rotation, at least one of the plurality of symbols being a trigger symbol and at least one of the plurality of symbols being a bonus symbol; and in response to the trigger symbol being displayed on the one or more display devices during the visual rotation of at least one of the symbol-bearing reels, causing the bonus symbols associated with a first one of the reels to be visually transferred from the first one of the reels to at least one of the other reels.

The method wherein the bonus symbols are visually transferred from the first one of the reels to the at least one of the other reels such that each of the visually transferred bonus symbols is associated with a symbol position in the column being occupied by the respective at least one of the other symbol-bearing reels.

The method can further include displaying a randomly selected outcome for the array of symbol positions on the one or more display devices, the randomly selected outcome including at least a portion of the plurality of symbols and the visually transferred bonus symbols such that each of the visually transferred bonus symbols remains associated with the respective symbol positions during evaluation of the outcome.

The method can further include evaluating the randomly selected outcome to determine if the outcome is a winning outcome.

Bingo/Keno Game Populated with Spinning Symbols from Reels

A method for conducting a wagering game via a gaming terminal including receiving, via an input device, a wager to play the wagering game; displaying, on one or more display devices, an array of symbol positions arranged in a plurality of columns; visually moving at least a portion of a plurality of symbols with respect to the array of symbol positions on the one or more display devices, one or more of the plurality of the symbols being alphanumeric symbols associated with a number or a letter; and in response to one of the alphanumeric symbols being visually moved on the one or more display devices, causing the visually moved alphanumeric symbols to visually interact with a game board adjacent to the displayed array of symbol positions on the one or more display devices.

The method wherein the visual interaction with the game board includes populating the game board with the visually moved alphanumeric symbols.

The method can further include evaluating the visually moved alphanumeric symbols populated on the game board to determine if the populated symbols comprise a winning outcome.

The method wherein the game board is a bingo game board or a keno game board.

Each of the disclosed concepts and obvious variations thereof is contemplated as falling within the spirit and scope of the claimed invention, which is set forth in the following claims.

The invention claimed is:

1. A gaming system primarily dedicated to playing at least one casino wagering game, the gaming system comprising:

a gaming cabinet for housing components associated with the casino wagering game;

an electronic input device coupled to the gaming cabinet, the electronic input device configured to receive a physical input from a player to initiate the casino wagering game and transform the input into an electronic data signal;

one or more electronic display devices coupled to the gaming cabinet;

a random element generator configured to generate one or more random elements; and one or more controllers configured to:

initiate the casino wagering game in response to the electronic data signal from the electronic input device;

determine an outcome of the casino wagering game based, at least in part, on the one or more random elements;

direct at least one of the one or more electronic display devices to display a base array of symbol positions arranged in a plurality of columns;

cause a plurality of symbols, displayed on at least one of the one or more display devices, to be visually moved with respect to the base array of symbol positions, one of the plurality of symbols being an array-expansion symbol;

in response to the array-expansion symbol being visually moved with respect to the base array of symbol positions, expand the base array of symbol positions into an expanded array of symbol positions, the expanded array of symbol positions including the base array of symbol positions and at least one additional symbol position;

direct at least one of the one or more electronic display devices to display the expanded array of symbol positions; and continue to cause at least a portion of the plurality of symbols to be visually moved with respect to the expanded array of symbol positions.

2. The system of claim 1, wherein the expanding only occurs in response to a predetermined number of array-expansion symbols being visually moved with respect to the base array of symbol positions.

3. The system of claim 1, wherein one of the at least a portion of the plurality of symbols is an array-shrinking symbol, and wherein the one or more controllers are further configured to:

in response to the array-shrinking symbol being visually moved with respect to the expanded array of symbol positions, shrink the expanded array of symbol positions into a shrunken array of symbol positions, the shrunken array of symbol positions having at least one less symbol position than the expanded array of symbol positions;

direct at least one of the one or more electronic display devices to display the shrunken array of symbol positions; and continue to cause at least a portion of the plurality of symbols to be visually moved with respect to the shrunken array of symbol positions on the one or more display devices.

4. The system of claim 3, wherein the one or more controllers are further configured to randomly distribute at least a portion of the plurality of symbols such that each of the symbol positions in the shrunken array of symbol positions is associated with one of the plurality of symbols.

5. A gaming system primarily dedicated to playing at least one casino wagering game, the gaming system comprising:

a gaming cabinet for housing components associated with the casino wagering game;

an electronic input device coupled to the gaming cabinet, the electronic input device configured to receive a physical input from a player to initiate the casino wagering game and transform the input into an electronic data signal;

one or more electronic at least one display devices coupled to the gaming cabinet;

a random element generator configured to generate one or more random elements; and one or more controllers configured to:

initiate the casino wagering game in response to the electronic data signal from the electronic input device;

determine an outcome of the casino wagering game based, at least in part, on the one or more random elements;

direct at least one of the one or more electronic display devices to display an array of symbol positions arranged in a plurality of columns;

visually move at least a portion of a plurality of symbols with respect to the array of symbol positions, one or more of the plurality of the symbols being special symbols; and in response to one or more of the special symbols being visually moved, cause the visually moved special symbols to be visually collected in a symbol collection area adjacent to the array of symbol positions.

6. The system of claim 5, wherein the one or more controllers are further configured to direct at least one of the one or more electronic display devices to display a randomly selected outcome of the wagering game such that each of the symbol positions is associated with a single one of the plurality of symbols.

7. The system of claim 6, wherein the one or more controllers are further configured to distribute the visually collected special symbols among the array of symbol positions such that each of the visually collected special symbols is associated with one of the symbol positions.

8. The system of claim 7, wherein the distributing occurs during the same play of the wagering game that the visually moved special symbols are visually collected in the symbol collection area.

9. The system of claim 7, wherein the special symbols are visually collected in the symbol collection area for two or more plays of the wagering game prior to the distributing.

10. The system of claim 7, wherein the one or more controllers are further configured to evaluate the randomly selected outcome including the distributed visually collected special symbols to determine if the outcome is a winning outcome; and in response to the outcome being a winning outcome, the gaming system is further caused to award a player of the wagering game with an award.

11. The system of claim 5, wherein the special symbols are wild symbols, bonus game triggering symbols, high pay symbols, or a combination thereof.

12. The system of claim 5, wherein the causing the visually moved special symbols to be visually collected in the symbol collection area occurs only in response to a predetermined number of the special symbols first being visually moved with respect to the array of symbol positions.

13. A gaming system machine primarily dedicated to playing at least one casino wagering game, the gaming machine comprising:

a gaming cabinet for housing components associated with the casino wagering game;

an electronic input device coupled to the gaming cabinet, the electronic input device configured to receive a physical input from a player to initiate the casino wagering game and transform the input into an electronic data signal;

one or more electronic display devices coupled to the gaming cabinet;

a random element generator configured to generate one or more random elements; and one or more controllers configured to:

initiate the casino wagering game in response to the electronic data signal from the electronic input device;

determine an outcome of the casino wagering game based, at least in part, on the one or more random elements;

direct at least one of the one or more electronic display devices to display a plurality of symbol-bearing reels, each of the symbol-bearing reels including a plurality of symbols, at least one of the symbols being a bonus symbol;

cause the symbol-bearing reels to visually rotate such that at least a portion of the symbols are displayed during the visual rotation;

in response to the bonus symbol being displayed during the visual rotation of at least one of the symbol-bearing reels, cause the bonus symbol to visually move from the rotating symbol-bearing reel towards at least one object; and cause the moving bonus symbol to interact with the at least one object.

14. The machine of claim 13, wherein the causing the bonus symbol to visually move only occurs in response to a predetermined number of bonus symbols being displayed on at least one of the one or more electronic display devices during the visual rotation of at least one of the symbol-bearing reels.

15. The machine of claim 13, wherein the one or more controllers are further configured to cause the bonus symbol to interact with the at least one object such that an award associated with the at least one object is revealed to a player of the wagering game.

16. The machine of claim 15, wherein the award includes credits, a multiplier, a bonus game, one or more free plays of the wagering game, or a combination thereof.

17. The machine of claim 13, wherein the at least one object is a plurality of objects displayed on a portion of the at least one display device positioned above the displayed plurality of symbol-bearing reels.

18. The machine of claim 13, wherein the at least one object is a plurality of objects and wherein the bonus symbol is a target selection symbol and each of the objects is a target.

19. The machine of claim 18, wherein the one or more controllers are further configured to cause the target selection symbol to randomly select one of the targets.

20. The machine of claim 19, wherein the one or more controllers are further configured to cause the target selection symbol to visually engage with the randomly selected target such that an award associated with the engaged target is revealed on the one or more display devices.

21. The machine of claim 13, wherein the one or more controllers are further configured to:

determine a number of the at least one object based on the amount of the received wager; and in response to the determined number being one or greater, cause at least one of the one or more electronic display devices to display a first one of the at least one object, the first object being associated with a first one of the symbol-bearing reels.

22. The machine of claim 21, wherein, in response to the determined number being two or greater, the one or more controllers are further configured to display a second one of the at least one object, the second object being associated with a second one of the symbol-bearing reels.

23. The machine system of claim 22, wherein the one or more controllers are is further configured to:

cause the visually moving bonus symbol to interact with the first object; and in response to the visually moving bonus symbol interacting with the first object, cause the moving bonus symbol to interact with the second object.

24. The machine of claim 23, wherein the one or more controllers are further configured to cause the bonus symbol to interact with the second object such that an award associated with the second object is revealed to a player of the wagering game.

25. The machine of claim 24, wherein the award associated with the second object is larger than a potential award associated with the first object.

26. The machine of claim 13, wherein the at least one object is displayed on a portion of at least one of the one or more electronic display devices positioned below the displayed plurality of symbol-bearing reels.

27. A community gaming system comprising:

a plurality of gaming terminals, each terminal of the plurality being configured to play at least one casino wagering game, each terminal of the plurality including at least one electronic display device;

a random element generator configured to generate one or more random elements;

at least one community display device; and at least one processor;

one or more controllers configured to:

receive a wager to play the casino wagering game on at least one of the gaming terminals;

determine an outcome of the casino wagering game based, at least in part, on the one or more random elements;

direct the at least one gaming terminal to display a plurality of symbol-bearing reels, the symbol-bearing reels including a plurality of symbols, at least one of the symbols being a trigger symbol;

direct the at least one community display device to display a community-bonus symbol for each of the plurality of gaming terminals;

cause the symbol-bearing reels displayed on the at least one gaming terminal to visually rotate such that at least a portion of the symbols are displayed during the visual rotation; and in response to the trigger symbol being displayed during the visual rotation of at least one of the symbol-bearing reels, visually increment the community-bonus symbol on the at least one community display device corresponding to the at least one gaming terminal.

28. The system of claim 27, wherein at least one of the one or more controllers is further configured caused to the community-bonus symbol corresponding to the at least one gaming terminal to visually move towards a finish line.

29. The system of claim 27, wherein, in response to the community-bonus symbol corresponding to the at least one gaming terminal being visually incremented a predetermined number of times, at least one of the one or more controllers is further configured to award the player of the at least one gaming terminal with a community bonus award.

* * * * *